US006932577B2

(12) United States Patent
Strohl et al.

(10) Patent No.: US 6,932,577 B2
(45) Date of Patent: Aug. 23, 2005

(54) TURBINE BLADE AIRFOIL HAVING IMPROVED CREEP CAPABILITY

(75) Inventors: J. Page Strohl, Tequesta, FL (US); David G. Parker, Palm Beach Gardens, FL (US); Michael Barrett, Stuart, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 209 days.

(21) Appl. No.: 10/719,927

(22) Filed: Nov. 21, 2003

(65) Prior Publication Data

US 2005/0111978 A1 May 26, 2005

(51) Int. Cl.[7] ..... F01D 5/14; F01D 5/18

(52) U.S. Cl. ..... 416/223 A; 416/97 R; 416/92

(58) Field of Search ..... 418/92, 97 R, 418/223 A, 243, 193 A

(56) References Cited

U.S. PATENT DOCUMENTS 5,980,209 A * 11/1999 Barry et al. ..... 416/223 A
6,474,948 B1 * 11/2002 Pirolla et al. ..... 416/243
6,503,059 B1 * 1/2003 Frost et al. ..... 416/223 A

OTHER PUBLICATIONS

U.S. Appl. Ser. No. 10/434691, Parker et al.

* cited by examiner

*Primary Examiner*—Ninh H. Nguyen
(74) *Attorney, Agent, or Firm*—Brian R. Mack

(57) ABSTRACT

A turbine blade including an airfoil having a profile in accordance with Table 1 is disclosed. The turbine blade has a plurality of cooling passages extending radially outward through the airfoil. The aerodynamic profile of the airfoil has been reconfigured to reduce airfoil stress for a given operating temperature, thereby resulting in increased creep rupture life of the airfoil.

10 Claims, 5 Drawing Sheets

TURBINE BLADE AIRFOIL HAVING IMPROVED CREEP CAPABILITY

BACKGROUND OF THE INVENTION

1. Field of the Invention

The present invention generally relates to a shrouded turbine blade for a gas turbine engine and more specifically to an improved airfoil profile resulting in improved creep rupture life.

2. Description of Related Art

A gas turbine engine typically comprises a multi-stage compressor, which compresses air drawn into the engine to a higher pressure and temperature. A majority of this air passes to the combustors, which mix the compressed heated air with fuel and contain the resulting reaction that generates the hot combustion gases. These gases then pass through a multi-stage turbine which drives the compressor, before exiting the engine. A portion of the compressed air from the compressor bypasses the combustors and is used to cool the turbine blades and vanes that are continuously exposed to the hot gases of the combustors. In land-based gas turbines, the turbine is also coupled to a generator for generating electricity.

In order to reduce operational costs of the gas turbine engine, it is desirable to increase the component life of replaceable items, such as turbine blades and vanes. This demand for more durable turbine components continues to increase today, especially with higher operating temperatures that are required to increase turbine engine performance. Although these components can often be repaired multiple times, eventually they must be replaced. In order to accommodate higher temperatures and longer exposure to such temperatures, enhanced turbine blade configurations are required, either through more efficient cooling or reduced stress of the turbine blade airfoil.

A known life-limiting factor for a turbine blade is creep, which is plastic deformation of the blade caused by slippage along crystallographic directions in the individual crystals of the metallic blade. This typically occurs when a turbine blade is exposed to high operating temperatures and a high stress level for an extended period of time, causing the blade to stretch. Depending on the operating conditions, the turbine blade will eventually stretch or creep to a shape that is no longer within the manufacturers acceptable limits and must be replaced. Creep life for turbine blades can be measured in terms of useable creep life, that is the amount of time in hours, until the part must be replaced, or in terms of creep rupture life, that is the amount of time until failure or rupture of the material. One skilled in the art of turbine blade design will understand that the useable creep life of a turbine blade is a percentage of the creep rupture life. However, this useable creep life varies amongst turbine blade manufacturers.

In order to extend the creep life of a turbine blade, either the temperature that the blade is exposed to must be reduced through enhanced cooling, or the stress on the blade must be reduced. The stress level on the blade can be reduced by altering the aerodynamic shape of the airfoil portion of the blade, which in turn, reduces the mechanical load. However, when attempting to enhance cooling, given a known amount of cooling air, new and more costly casting and manufacturing processes may be necessary in order to improve the cooling.

Therefore, what is desired is a turbine blade that utilizes the existing cooling air, yet has an airfoil profile that has increased life due to a lower airfoil creep rate as a result of lower mechanical loading.

SUMMARY AND OBJECTS OF THE INVENTION

In the preferred embodiment of the present invention, an airfoil for a turbine blade having an attachment with a platform extending generally radially outward from the attachment is disclosed with the airfoil having an uncoated profile substantially in accordance with Cartesian coordinate values of X, Y, and Z as set forth in Table 1, carried only to three decimal places, wherein Z is a distance measured radially from the platform to which the airfoil is mounted. Extending from the airfoil, opposite of the platform, is a shroud having a reduced weight design in accordance with U.S. Pat. No. 6,491,498, assigned to the same assignee herein.

In an effort to increase the creep life of the blade, the mechanical loading on the airfoil by the gases passing through the turbine have been reduced. Creep life of a material is a function of the material properties, the stress level applied to the material, and extended exposure of the material to elevated temperatures. For cases where temperature of the material cannot be lowered, the creep life can be extended by lowering the mechanical load on the material, which for the present invention is accomplished by altering the aerodynamic shape of the airfoil.

It is an object of the present invention to provide a turbine blade having a novel airfoil geometry with lower mechanical load to the airfoil that results in increased creep life for a given operating temperature.

In accordance with this and other objects, which will become apparent hereinafter, the instant invention will now be described with particular reference to the accompanying drawings.

DETAILED DESCRIPTION OF THE PREFERRED EMBODIMENT

Figure 1:
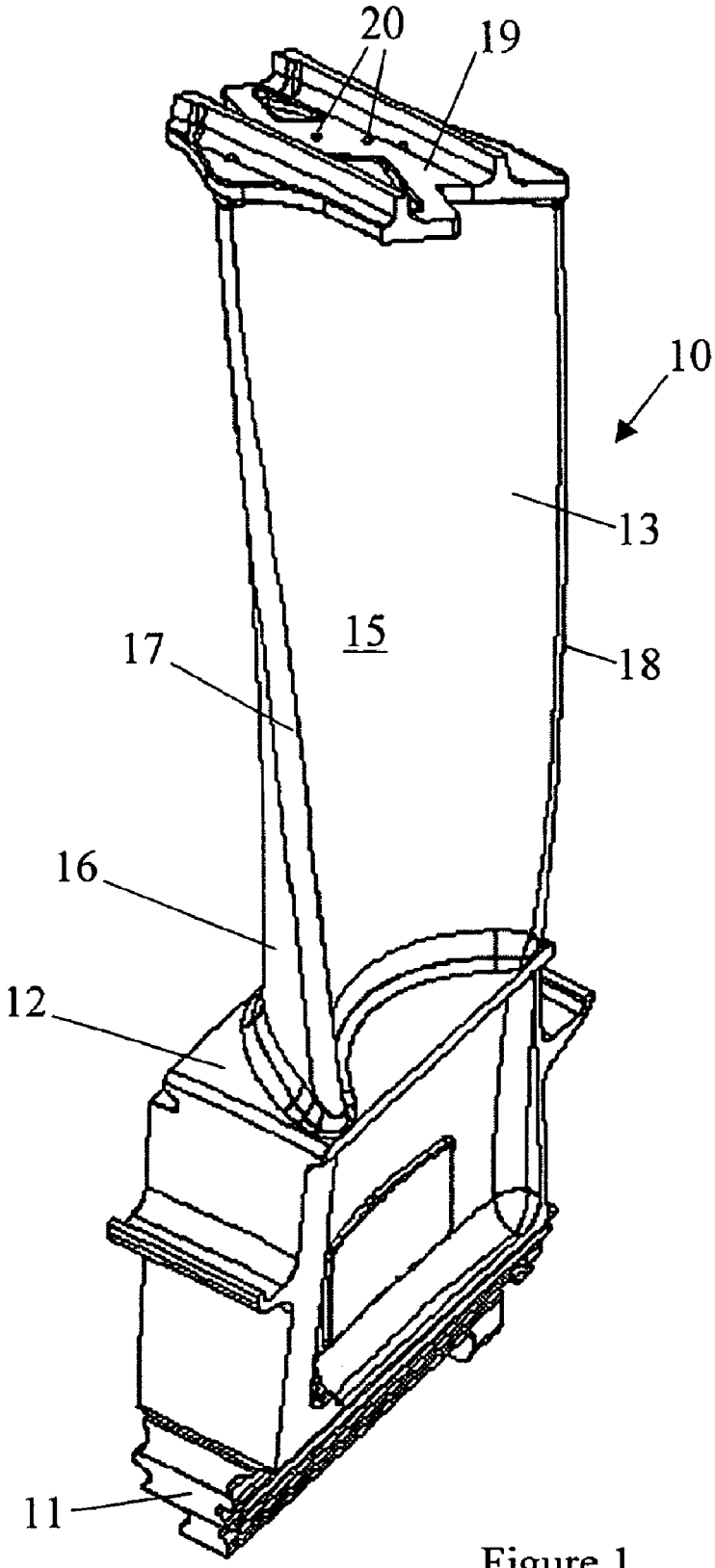
FIG. 1 is a perspective view of a turbine blade including an airfoil in accordance with the present invention.

Referring to FIG. 1, a turbine blade 10 is shown in accordance with the present invention. Turbine blade 10 includes an attachment 11 and a platform 12 extending generally radially outward from attachment 11. An airfoil 13 extends generally radially outward from platform 12. Airfoil 13 has a compound curvature that includes a concave side 15 and a convex side 16 joined together at leading edge 17 and trailing edge 18. Extending generally radially outward from airfoil 13 is a shroud 19 that is used to dampen vibrations between adjacent turbine blades while also providing a seal to the outer gas path profile to prevent leakage of the hot combustion gases. Turbine blade 10 is cast from a nickelbased superalloy to provide superior resistance to the elevated temperatures of the hot combustion gases that drive the turbine.

To combat the elevated temperatures experienced by turbine blade 10, the blade is cooled by a plurality of generally radially extending holes 20 that extend from attachment 11, through platform 12, airfoil 13, and shroud 19 to the blade tip. Holes 20 pass a cooling medium, typically air or steam, through blade 10 to primarily cool airfoil 13. In the preferred embodiment, the plurality of radially extending holes 20 comprises six holes, but the number and diameter of holes 20 may vary depending on the amount of cooling required and geometric limitations of blade 10.

Figure 2:
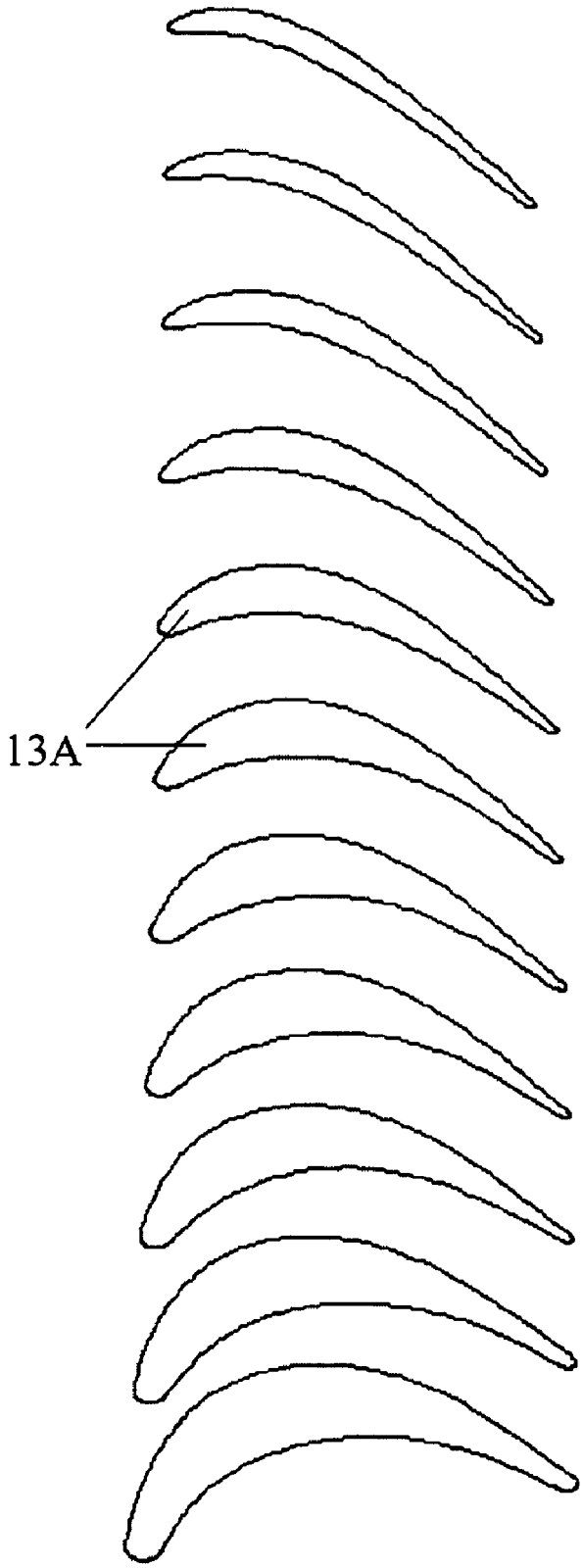
FIG. 2 is a perspective view illustrating the various airfoil profile sections outlined in the Cartesian coordinates of Table 1.

Airfoil 13 has an uncoated profile substantially in accordance with Cartesian coordinate values X, Y, and Z as set forth in Table 1, wherein Z is measured radially from platform 12 and X is generally parallel to the engine centerline about which turbine blade 10 rotates in operation. All coordinate values X, Y, and Z are measured in inches and are carried to three decimal places. A series of sections 13A are created at each radial distance Z by connecting the X and Y coordinates with smooth arcs. These sections are shown in perspective view in FIG. 2. The surfaces of airfoil 13, including concave side 15, convex side 16, leading edge 17, and trailing edge 18 can then be created by connecting adjacent sections of X,Y coordinate data. Depending on manufacturing tolerances, the profile of a single section of airfoil 13 can vary with an overall tolerance envelope for the section of +/−0.100 inches relative to the profile generated by the Cartesian coordinate values of X, Y, and Z as set forth in Table 1.

It is important to note that the airfoil profile generated by the X, Y, and Z Cartesian coordinate values set forth in Table 1 may be used in various turbine engines, provided the appropriate scaling factor has been applied to the coordinate values. That is, the airfoil shape may be maintained by applying a scaling factor to the coordinate values to either increase or decrease the size of the airfoil.

Figure 3:
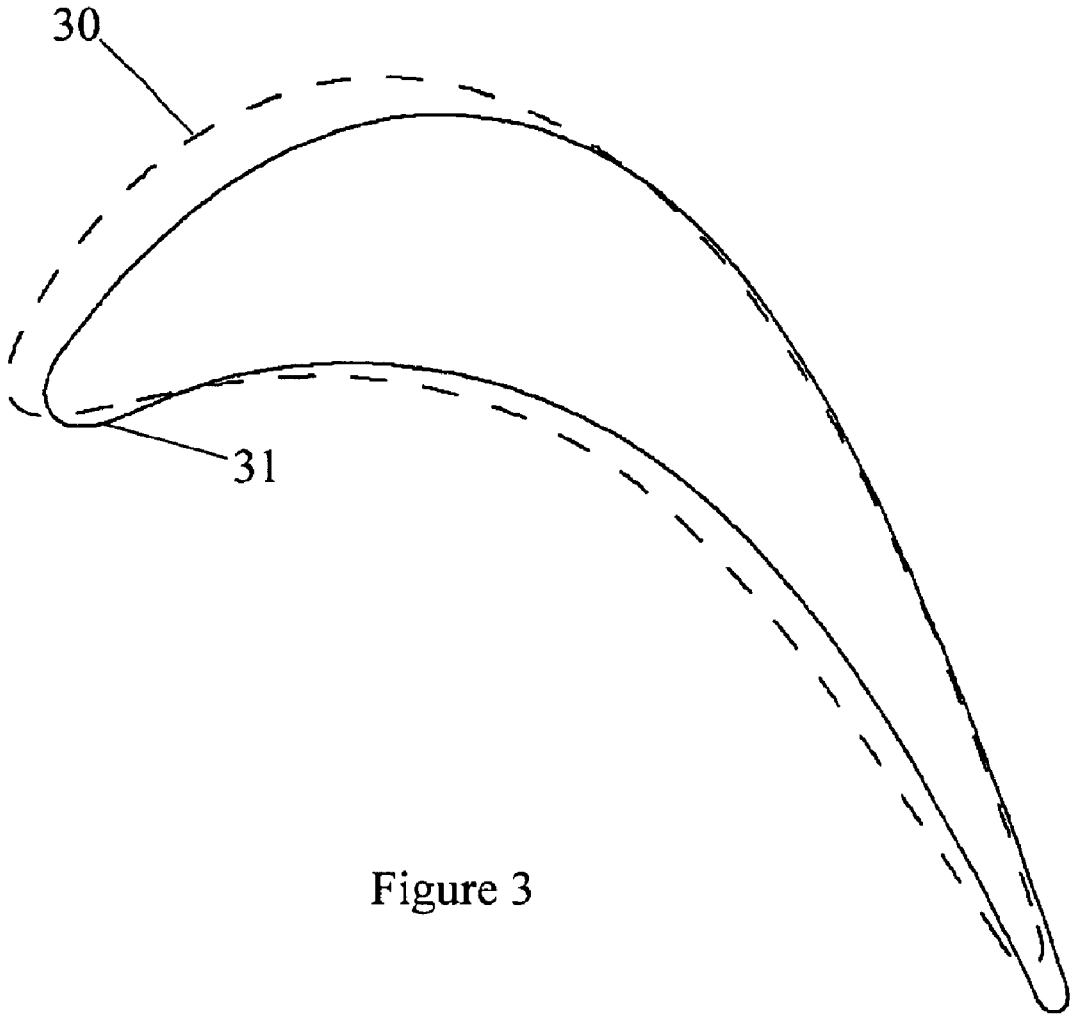
FIG. 3 is a cross section view overlaying an airfoil section of the present invention with an airfoil section of the prior art.
Figure 4:
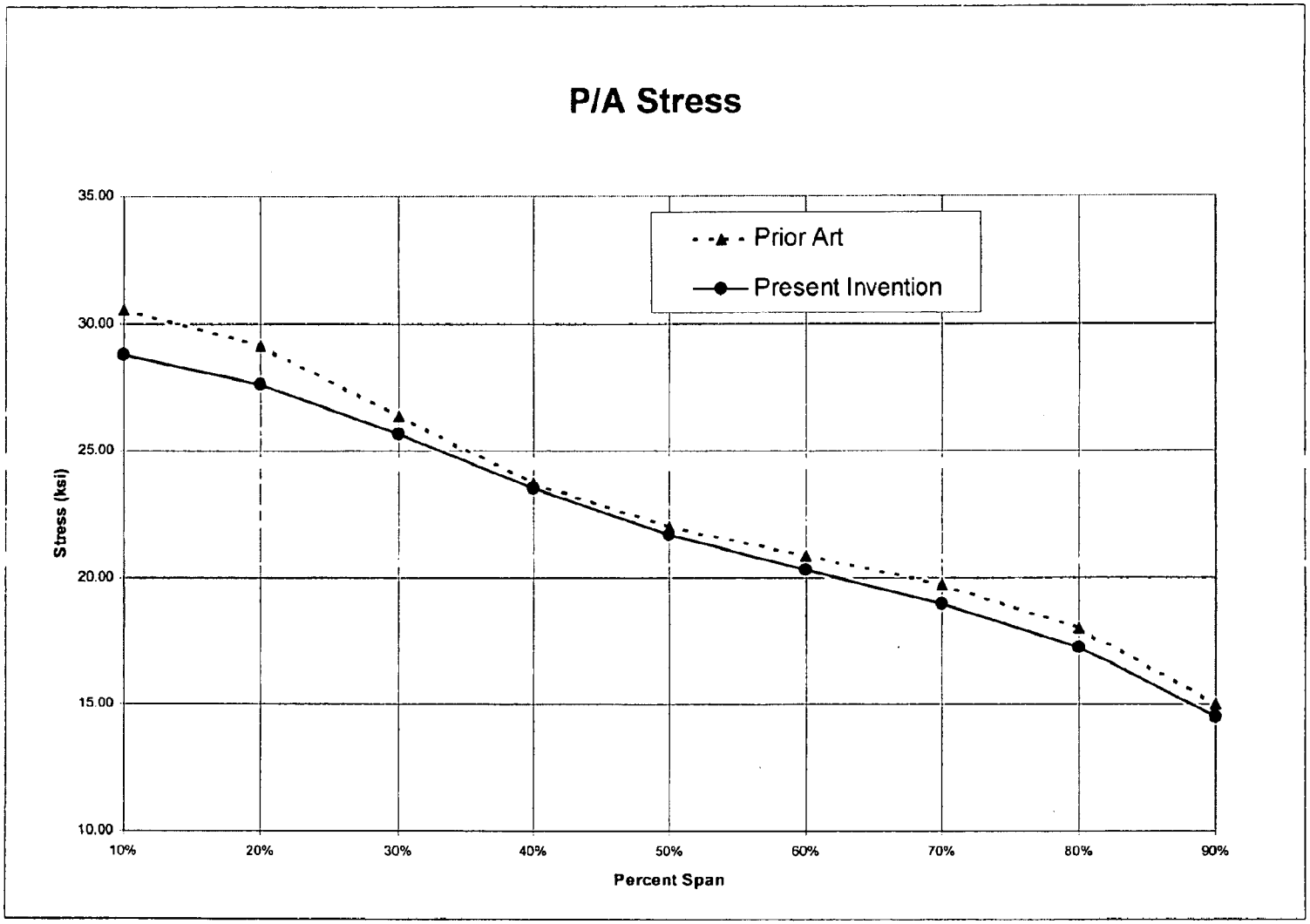
FIG. 4 is a chart displaying the radial stress versus percent span of the airfoil for the prior art and present invention.

Referring now to FIG. 3, a cross section 31 of airfoil 13 disclosed in the present invention is shown overlayed with an airfoil cross section 30 of a prior art blade used in the same turbine stage of the same engine. Cross sections 30 and 31 are taken at the same radial height, approximately mid-span of the airfoil, and the radially extending cooling holes have been removed for clarity purposes. Adjusting the aerodynamic profile of the airfoil allows for excess material to be removed from the airfoil while maintaining the required turbine performance. For example, the section of airfoil 13 approaching shroud 19 has been thinned out to increase the local heat transfer of the cooling air and to reduce the airfoil weight. When calculating the mechanical pull of the turbine blade on the attachment 1, reducing the airfoil weight exponentially reduces mechanical pull as you move radially outward towards the blade tip. Although these cross sections are only representative, they do show the geometric differences necessary to reduce the mechanical load experienced along the airfoil. Lowering the pull, or mechanical load, at each section of the airfoil decreases the radial stress component (P/A) throughout the airfoil. This trend can be seen graphically in FIG. 4, which plots P/A stress (typically defined as the radial pull load in thousands of pounds per unit area in square inches) versus percent span of the airfoil. It can be seen from FIG. 4 that the P/A stress component of the airfoil in accordance with the X, Y, and Z Cartesian coordinates of the present invention is lower across the entire airfoil span compared to the airfoil of the prior art.

Figure 5:
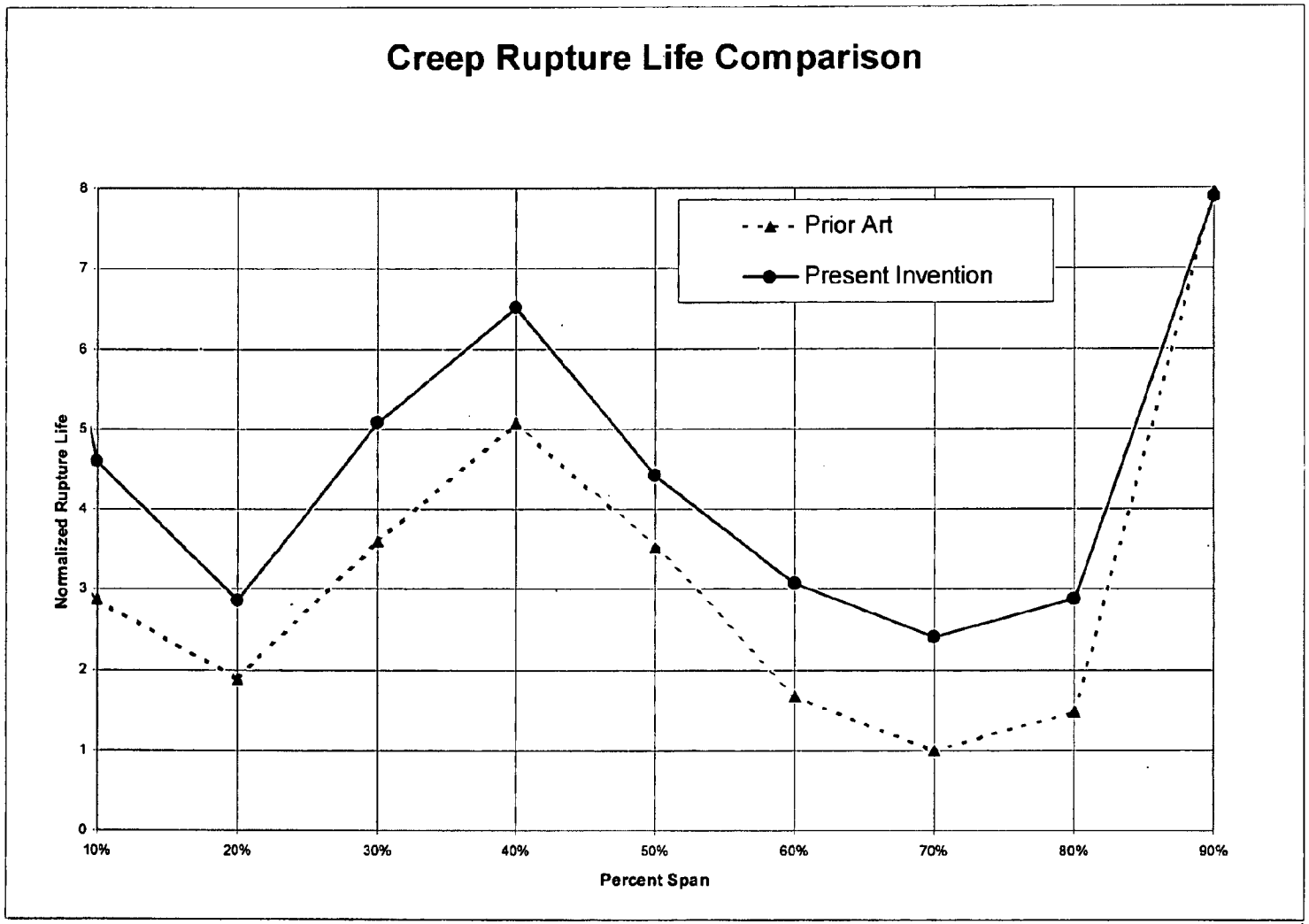
FIG. 5 is a chart comparing normalized creep rupture life versus percent span of the airfoil for the prior art and present invention.

As mentioned previously, creep rupture life for a given material is a function of the material properties, the stress level applied to the material, and extended exposure of the material to elevated temperatures. During operation, a turbine blade creeps, or grows, such that after a certain amount of runtime, the blade is no longer useable, and must be replaced. However, creep life of a turbine blade can be extended by either reducing the stress level or lowering the temperature at which the blade under stress is exposed. For the present invention, the P/A stress component has been reduced across the entire airfoil span, which results in an improvement in creep life. Referring now to FIG. 5, a graphical representation of the normalized creep rupture life versus percent span is shown for both the airfoil of the prior art and the airfoil in accordance with the X, Y, and Z Cartesian coordinates of the present invention. From FIG. 5, it can be seen that the life limiting location with regards to creep rupture in the prior art airfoil was located at the 70% span location. By altering the aerodynamic design of the prior art airfoil, stress levels in the present invention airfoil are lowered, and the creep rupture life for the same 70% span location is increased by nearly 140%, more than doubling the creep rupture life at this location. Moreover, when comparing the normalized creep rupture life of the prior art airfoil and the present invention airfoil, it can be seen that the creep rupture life for the present invention airfoil is increased for nearly all airfoil locations. As a result, the useable blade creep life increases at a rate that is directly proportional to the increase in creep rupture life, thereby further extending turbine blade life.

TABLE 1

| X | Y | Z |
|---|---|---|
| 1.239 | −0.814 | 0.000 |
| 1.247 | −0.826 | 0.000 |
| 1.256 | −0.838 | 0.000 |
| 1.267 | −0.850 | 0.000 |
| 1.280 | −0.862 | 0.000 |
| 1.295 | −0.870 | 0.000 |
| 1.313 | −0.875 | 0.000 |
| 1.332 | −0.874 | 0.000 |
| 1.351 | −0.867 | 0.000 |
| 1.366 | −0.855 | 0.000 |
| 1.377 | −0.839 | 0.000 |
| 1.383 | −0.821 | 0.000 |
| 1.384 | −0.803 | 0.000 |
| 1.382 | −0.785 | 0.000 |
| 1.377 | −0.769 | 0.000 |
| 1.372 | −0.754 | 0.000 |
| 1.366 | −0.741 | 0.000 |
| 1.303 | −0.604 | 0.000 |
| 1.239 | −0.472 | 0.000 |
| 1.174 | −0.345 | 0.000 |
| 1.107 | −0.223 | 0.000 |
| 0.967 | 0.006 | 0.000 |
| 0.892 | 0.112 | 0.000 |
| 0.812 | 0.211 | 0.000 |
| 0.726 | 0.302 | 0.000 |
| 0.634 | 0.385 | 0.000 |
| 0.537 | 0.456 | 0.000 |
| 0.433 | 0.516 | 0.000 |
| 0.323 | 0.561 | 0.000 |
| 0.210 | 0.591 | 0.000 |
| 0.096 | 0.605 | 0.000 |
| −0.019 | 0.602 | 0.000 |
| −0.131 | 0.585 | 0.000 |
| −0.240 | 0.554 | 0.000 |
| −0.344 | 0.510 | 0.000 |
| −0.442 | 0.456 | 0.000 |
| −0.534 | 0.392 | 0.000 |
| −0.620 | 0.321 | 0.000 |
| −0.701 | 0.244 | 0.000 |

TABLE 1-continued

| X | Y | Z |
|---|---|---|
| −0.777 | 0.160 | 0.000 |
| −0.916 | −0.020 | 0.000 |
| −1.041 | −0.216 | 0.000 |
| −1.100 | −0.319 | 0.000 |
| −1.156 | −0.426 | 0.000 |
| −1.209 | −0.537 | 0.000 |
| −1.260 | −0.652 | 0.000 |
| −1.277 | −0.697 | 0.000 |
| −1.283 | −0.722 | 0.000 |
| −1.284 | −0.747 | 0.000 |
| −1.270 | −0.796 | 0.000 |
| −1.254 | −0.816 | 0.000 |
| −1.233 | −0.831 | 0.000 |
| −1.209 | −0.839 | 0.000 |
| −1.184 | −0.841 | 0.000 |
| −1.159 | −0.836 | 0.000 |
| −1.136 | −0.826 | 0.000 |
| −1.100 | −0.794 | 0.000 |
| −1.086 | −0.775 | 0.000 |
| −1.073 | −0.756 | 0.000 |
| −1.018 | −0.678 | 0.000 |
| −0.961 | −0.605 | 0.000 |
| −0.842 | −0.474 | 0.000 |
| −0.715 | −0.362 | 0.000 |
| −0.582 | −0.267 | 0.000 |
| −0.441 | −0.191 | 0.000 |
| −0.293 | −0.133 | 0.000 |
| −0.140 | −0.095 | 0.000 |
| 0.018 | −0.078 | 0.000 |
| 0.179 | −0.082 | 0.000 |
| 0.342 | −0.109 | 0.000 |
| 0.424 | −0.132 | 0.000 |
| 0.505 | −0.162 | 0.000 |
| 0.664 | −0.241 | 0.000 |
| 0.742 | −0.291 | 0.000 |
| 0.818 | −0.347 | 0.000 |
| 0.965 | −0.478 | 0.000 |
| 1.105 | −0.634 | 0.000 |
| 1.239 | −0.814 | 0.000 |
| 1.228 | −0.883 | 0.398 |
| 1.235 | −0.893 | 0.398 |
| 1.242 | −0.903 | 0.398 |
| 1.251 | −0.914 | 0.398 |
| 1.262 | −0.923 | 0.398 |
| 1.275 | −0.930 | 0.398 |
| 1.290 | −0.934 | 0.398 |
| 1.305 | −0.933 | 0.398 |
| 1.320 | −0.928 | 0.398 |
| 1.333 | −0.918 | 0.398 |
| 1.342 | −0.905 | 0.398 |
| 1.347 | −0.891 | 0.398 |
| 1.349 | −0.876 | 0.398 |
| 1.347 | −0.861 | 0.398 |
| 1.344 | −0.848 | 0.398 |
| 1.339 | −0.835 | 0.398 |
| 1.334 | −0.823 | 0.398 |
| 1.279 | −0.700 | 0.398 |
| 1.222 | −0.580 | 0.398 |
| 1.164 | −0.463 | 0.398 |
| 1.104 | −0.349 | 0.398 |
| 0.979 | −0.131 | 0.398 |
| 0.913 | −0.028 | 0.398 |
| 0.842 | 0.071 | 0.398 |
| 0.767 | 0.164 | 0.398 |
| 0.687 | 0.251 | 0.398 |
| 0.601 | 0.330 | 0.398 |
| 0.509 | 0.400 | 0.398 |
| 0.412 | 0.459 | 0.398 |
| 0.309 | 0.506 | 0.398 |
| 0.202 | 0.540 | 0.398 |
| 0.092 | 0.559 | 0.398 |
| −0.019 | 0.563 | 0.398 |
| −0.131 | 0.552 | 0.398 |
| −0.241 | 0.527 | 0.398 |
| −0.347 | 0.487 | 0.398 |
| −0.449 | 0.436 | 0.398 |
| −0.545 | 0.373 | 0.398 |

TABLE 1-continued

| X | Y | Z |
|---|---|---|
| −0.634 | 0.302 | 0.398 |
| −0.717 | 0.223 | 0.398 |
| −0.866 | 0.048 | 0.398 |
| −0.997 | −0.144 | 0.398 |
| −1.056 | −0.246 | 0.398 |
| −1.113 | −0.350 | 0.398 |
| −1.167 | −0.458 | 0.398 |
| −1.218 | −0.570 | 0.398 |
| −1.236 | −0.613 | 0.398 |
| −1.242 | −0.636 | 0.398 |
| −1.244 | −0.660 | 0.398 |
| −1.233 | −0.707 | 0.398 |
| −1.219 | −0.727 | 0.398 |
| −1.200 | −0.743 | 0.398 |
| −1.177 | −0.752 | 0.398 |
| −1.153 | −0.755 | 0.398 |
| −1.129 | −0.751 | 0.398 |
| −1.107 | −0.741 | 0.398 |
| −1.072 | −0.712 | 0.398 |
| −1.057 | −0.694 | 0.398 |
| −1.044 | −0.677 | 0.398 |
| −0.985 | −0.604 | 0.398 |
| −0.925 | −0.536 | 0.398 |
| −0.799 | −0.411 | 0.398 |
| −0.664 | −0.304 | 0.398 |
| −0.520 | −0.216 | 0.398 |
| −0.369 | −0.149 | 0.398 |
| −0.213 | −0.105 | 0.398 |
| −0.053 | −0.084 | 0.398 |
| 0.108 | −0.087 | 0.398 |
| 0.267 | −0.113 | 0.398 |
| 0.423 | −0.162 | 0.398 |
| 0.500 | −0.194 | 0.398 |
| 0.575 | −0.233 | 0.398 |
| 0.720 | −0.325 | 0.398 |
| 0.790 | −0.378 | 0.398 |
| 0.858 | −0.437 | 0.398 |
| 0.988 | −0.568 | 0.398 |
| 1.111 | −0.717 | 0.398 |
| 1.228 | −0.883 | 0.398 |
| 1.213 | −0.944 | 0.797 |
| 1.219 | −0.953 | 0.797 |
| 1.225 | −0.962 | 0.797 |
| 1.233 | −0.971 | 0.797 |
| 1.242 | −0.979 | 0.797 |
| 1.253 | −0.984 | 0.797 |
| 1.265 | −0.987 | 0.797 |
| 1.278 | −0.987 | 0.797 |
| 1.290 | −0.982 | 0.797 |
| 1.300 | −0.975 | 0.797 |
| 1.308 | −0.965 | 0.797 |
| 1.313 | −0.953 | 0.797 |
| 1.315 | −0.941 | 0.797 |
| 1.314 | −0.928 | 0.797 |
| 1.311 | −0.917 | 0.797 |
| 1.307 | −0.906 | 0.797 |
| 1.303 | −0.895 | 0.797 |
| 1.253 | −0.782 | 0.797 |
| 1.203 | −0.672 | 0.797 |
| 1.151 | −0.563 | 0.797 |
| 1.098 | −0.456 | 0.797 |
| 0.985 | −0.247 | 0.797 |
| 0.926 | −0.147 | 0.797 |
| 0.863 | −0.049 | 0.797 |
| 0.797 | 0.046 | 0.797 |
| 0.727 | 0.136 | 0.797 |
| 0.651 | 0.221 | 0.797 |
| 0.570 | 0.299 | 0.797 |
| 0.483 | 0.369 | 0.797 |
| 0.389 | 0.429 | 0.797 |
| 0.290 | 0.478 | 0.797 |
| 0.186 | 0.514 | 0.797 |
| 0.077 | 0.537 | 0.797 |
| −0.035 | 0.543 | 0.797 |
| −0.148 | 0.534 | 0.797 |
| −0.259 | 0.509 | 0.797 |
| −0.367 | 0.470 | 0.797 |

TABLE 1-continued

| X | Y | Z |
|---|---|---|
| −0.470 | 0.417 | 0.797 |
| −0.566 | 0.353 | 0.797 |
| −0.655 | 0.280 | 0.797 |
| −0.814 | 0.113 | 0.797 |
| −0.951 | −0.074 | 0.797 |
| −1.013 | −0.173 | 0.797 |
| −1.071 | −0.275 | 0.797 |
| −1.126 | −0.381 | 0.797 |
| −1.179 | −0.489 | 0.797 |
| −1.196 | −0.531 | 0.797 |
| −1.203 | −0.553 | 0.797 |
| −1.206 | −0.576 | 0.797 |
| −1.198 | −0.622 | 0.797 |
| −1.185 | −0.643 | 0.797 |
| −1.168 | −0.659 | 0.797 |
| −1.146 | −0.668 | 0.797 |
| −1.123 | −0.672 | 0.797 |
| −1.100 | −0.669 | 0.797 |
| −1.078 | −0.660 | 0.797 |
| −1.042 | −0.633 | 0.797 |
| −1.027 | −0.616 | 0.797 |
| −1.013 | −0.600 | 0.797 |
| −0.951 | −0.533 | 0.797 |
| −0.888 | −0.469 | 0.797 |
| −0.754 | −0.352 | 0.797 |
| −0.612 | −0.252 | 0.797 |
| −0.461 | −0.173 | 0.797 |
| −0.303 | −0.117 | 0.797 |
| −0.141 | −0.087 | 0.797 |
| 0.022 | −0.082 | 0.797 |
| 0.183 | −0.102 | 0.797 |
| 0.339 | −0.146 | 0.797 |
| 0.488 | −0.212 | 0.797 |
| 0.559 | −0.252 | 0.797 |
| 0.628 | −0.297 | 0.797 |
| 0.760 | −0.399 | 0.797 |
| 0.823 | −0.456 | 0.797 |
| 0.884 | −0.516 | 0.797 |
| 1.001 | −0.646 | 0.797 |
| 1.110 | −0.789 | 0.797 |
| 1.213 | −0.944 | 0.797 |
| 1.195 | −0.998 | 1.195 |
| 1.200 | −1.006 | 1.195 |
| 1.205 | −1.014 | 1.195 |
| 1.212 | −1.022 | 1.195 |
| 1.220 | −1.029 | 1.195 |
| 1.229 | −1.034 | 1.195 |
| 1.239 | −1.036 | 1.195 |
| 1.250 | −1.036 | 1.195 |
| 1.260 | −1.032 | 1.195 |
| 1.269 | −1.026 | 1.195 |
| 1.276 | −1.018 | 1.195 |
| 1.280 | −1.008 | 1.195 |
| 1.282 | −0.998 | 1.195 |
| 1.281 | −0.987 | 1.195 |
| 1.279 | −0.977 | 1.195 |
| 1.276 | −0.967 | 1.195 |
| 1.272 | −0.958 | 1.195 |
| 1.228 | −0.853 | 1.195 |
| 1.182 | −0.749 | 1.195 |
| 1.136 | −0.647 | 1.195 |
| 1.087 | −0.545 | 1.195 |
| 0.986 | −0.344 | 1.195 |
| 0.933 | −0.246 | 1.195 |
| 0.877 | −0.149 | 1.195 |
| 0.818 | −0.054 | 1.195 |
| 0.755 | 0.038 | 1.195 |
| 0.688 | 0.126 | 1.195 |
| 0.616 | 0.210 | 1.195 |
| 0.538 | 0.288 | 1.195 |
| 0.453 | 0.358 | 1.195 |
| 0.361 | 0.420 | 1.195 |
| 0.263 | 0.470 | 1.195 |
| 0.158 | 0.506 | 1.195 |
| 0.048 | 0.528 | 1.195 |
| −0.065 | 0.534 | 1.195 |
| −0.178 | 0.523 | 1.195 |

TABLE 1-continued

| X | Y | Z |
|---|---|---|
| −0.289 | 0.495 | 1.195 |
| −0.396 | 0.454 | 1.195 |
| −0.498 | 0.399 | 1.195 |
| −0.592 | 0.333 | 1.195 |
| −0.761 | 0.176 | 1.195 |
| −0.905 | −0.005 | 1.195 |
| −0.969 | −0.101 | 1.195 |
| −1.030 | −0.201 | 1.195 |
| −1.087 | −0.304 | 1.195 |
| −1.140 | −0.409 | 1.195 |
| −1.159 | −0.450 | 1.195 |
| −1.166 | −0.471 | 1.195 |
| −1.170 | −0.494 | 1.195 |
| −1.164 | −0.540 | 1.195 |
| −1.153 | −0.561 | 1.195 |
| −1.137 | −0.577 | 1.195 |
| −1.116 | −0.588 | 1.195 |
| −1.093 | −0.592 | 1.195 |
| −1.070 | −0.590 | 1.195 |
| −1.048 | −0.582 | 1.195 |
| −1.012 | −0.556 | 1.195 |
| −0.996 | −0.541 | 1.195 |
| −0.981 | −0.526 | 1.195 |
| −0.916 | −0.463 | 1.195 |
| −0.850 | −0.404 | 1.195 |
| −0.710 | −0.296 | 1.195 |
| −0.562 | −0.206 | 1.195 |
| −0.405 | −0.137 | 1.195 |
| −0.243 | −0.093 | 1.195 |
| −0.078 | −0.076 | 1.195 |
| 0.086 | −0.086 | 1.195 |
| 0.245 | −0.121 | 1.195 |
| 0.396 | −0.180 | 1.195 |
| 0.536 | −0.259 | 1.195 |
| 0.603 | −0.305 | 1.195 |
| 0.667 | −0.355 | 1.195 |
| 0.788 | −0.464 | 1.195 |
| 0.845 | −0.523 | 1.195 |
| 0.900 | −0.585 | 1.195 |
| 1.005 | −0.714 | 1.195 |
| 1.103 | −0.852 | 1.195 |
| 1.195 | −0.998 | 1.195 |
| 1.173 | −1.045 | 1.593 |
| 1.178 | −1.053 | 1.593 |
| 1.183 | −1.061 | 1.593 |
| 1.189 | −1.068 | 1.593 |
| 1.196 | −1.074 | 1.593 |
| 1.204 | −1.078 | 1.593 |
| 1.213 | −1.080 | 1.593 |
| 1.222 | −1.080 | 1.593 |
| 1.231 | −1.077 | 1.593 |
| 1.238 | −1.072 | 1.593 |
| 1.244 | −1.065 | 1.593 |
| 1.248 | −1.057 | 1.593 |
| 1.250 | −1.048 | 1.593 |
| 1.250 | −1.038 | 1.593 |
| 1.248 | −1.029 | 1.593 |
| 1.246 | −1.020 | 1.593 |
| 1.242 | −1.011 | 1.593 |
| 1.202 | −0.913 | 1.593 |
| 1.161 | −0.815 | 1.593 |
| 1.118 | −0.717 | 1.593 |
| 1.074 | −0.619 | 1.593 |
| 0.982 | −0.425 | 1.593 |
| 0.933 | −0.329 | 1.593 |
| 0.883 | −0.233 | 1.593 |
| 0.830 | −0.138 | 1.593 |
| 0.774 | −0.045 | 1.593 |
| 0.714 | 0.045 | 1.593 |
| 0.649 | 0.133 | 1.593 |
| 0.579 | 0.216 | 1.593 |
| 0.501 | 0.294 | 1.593 |
| 0.417 | 0.364 | 1.593 |
| 0.325 | 0.425 | 1.593 |
| 0.226 | 0.473 | 1.593 |
| 0.120 | 0.508 | 1.593 |
| 0.009 | 0.526 | 1.593 |

TABLE 1-continued

| X | Y | Z |
|---|---|---|
| −0.104 | 0.528 | 1.593 |
| −0.216 | 0.514 | 1.593 |
| −0.326 | 0.483 | 1.593 |
| −0.431 | 0.438 | 1.593 |
| −0.530 | 0.381 | 1.593 |
| −0.707 | 0.236 | 1.593 |
| −0.859 | 0.063 | 1.593 |
| −0.926 | −0.030 | 1.593 |
| −0.989 | −0.128 | 1.593 |
| −1.048 | −0.228 | 1.593 |
| −1.103 | −0.330 | 1.593 |
| −1.123 | −0.370 | 1.593 |
| −1.130 | −0.391 | 1.593 |
| −1.135 | −0.414 | 1.593 |
| −1.132 | −0.460 | 1.593 |
| −1.122 | −0.481 | 1.593 |
| −1.107 | −0.498 | 1.593 |
| −1.086 | −0.510 | 1.593 |
| −1.063 | −0.515 | 1.593 |
| −1.040 | −0.513 | 1.593 |
| −1.019 | −0.506 | 1.593 |
| −0.981 | −0.482 | 1.593 |
| −0.965 | −0.468 | 1.593 |
| −0.949 | −0.453 | 1.593 |
| −0.882 | −0.395 | 1.593 |
| −0.812 | −0.341 | 1.593 |
| −0.667 | −0.243 | 1.593 |
| −0.514 | −0.164 | 1.593 |
| −0.353 | −0.107 | 1.593 |
| −0.189 | −0.076 | 1.593 |
| −0.023 | −0.072 | 1.593 |
| 0.139 | −0.095 | 1.593 |
| 0.294 | −0.143 | 1.593 |
| 0.439 | −0.214 | 1.593 |
| 0.572 | −0.304 | 1.593 |
| 0.634 | −0.354 | 1.593 |
| 0.693 | −0.407 | 1.593 |
| 0.804 | −0.522 | 1.593 |
| 0.856 | −0.582 | 1.593 |
| 0.906 | −0.644 | 1.593 |
| 1.001 | −0.773 | 1.593 |
| 1.090 | −0.907 | 1.593 |
| 1.173 | −1.045 | 1.593 |
| 1.150 | −1.088 | 1.992 |
| 1.154 | −1.095 | 1.992 |
| 1.158 | −1.103 | 1.992 |
| 1.164 | −1.109 | 1.992 |
| 1.170 | −1.114 | 1.992 |
| 1.177 | −1.118 | 1.992 |
| 1.185 | −1.120 | 1.992 |
| 1.193 | −1.120 | 1.992 |
| 1.201 | −1.118 | 1.992 |
| 1.208 | −1.113 | 1.992 |
| 1.214 | −1.107 | 1.992 |
| 1.218 | −1.100 | 1.992 |
| 1.220 | −1.092 | 1.992 |
| 1.220 | −1.083 | 1.992 |
| 1.218 | −1.075 | 1.992 |
| 1.216 | −1.066 | 1.992 |
| 1.213 | −1.058 | 1.992 |
| 1.176 | −0.964 | 1.992 |
| 1.138 | −0.870 | 1.992 |
| 1.099 | −0.775 | 1.992 |
| 1.058 | −0.681 | 1.992 |
| 0.973 | −0.492 | 1.992 |
| 0.929 | −0.397 | 1.992 |
| 0.883 | −0.303 | 1.992 |
| 0.834 | −0.209 | 1.992 |
| 0.784 | −0.116 | 1.992 |
| 0.729 | −0.024 | 1.992 |
| 0.671 | 0.066 | 1.992 |
| 0.607 | 0.153 | 1.992 |
| 0.537 | 0.235 | 1.992 |
| 0.459 | 0.312 | 1.992 |
| 0.374 | 0.380 | 1.992 |
| 0.280 | 0.438 | 1.992 |
| 0.180 | 0.483 | 1.992 |

TABLE 1-continued

| X | Y | Z |
|---|---|---|
| 0.073 | 0.513 | 1.992 |
| −0.037 | 0.527 | 1.992 |
| −0.149 | 0.525 | 1.992 |
| −0.260 | 0.506 | 1.992 |
| −0.367 | 0.471 | 1.992 |
| −0.469 | 0.423 | 1.992 |
| −0.654 | 0.293 | 1.992 |
| −0.813 | 0.129 | 1.992 |
| −0.883 | 0.039 | 1.992 |
| −0.949 | −0.055 | 1.992 |
| −1.010 | −0.153 | 1.992 |
| −1.068 | −0.253 | 1.992 |
| −1.088 | −0.292 | 1.992 |
| −1.096 | −0.313 | 1.992 |
| −1.102 | −0.335 | 1.992 |
| −1.102 | −0.381 | 1.992 |
| −1.093 | −0.403 | 1.992 |
| −1.078 | −0.421 | 1.992 |
| −1.058 | −0.433 | 1.992 |
| −1.035 | −0.438 | 1.992 |
| −1.012 | −0.437 | 1.992 |
| −0.990 | −0.431 | 1.992 |
| −0.951 | −0.409 | 1.992 |
| −0.934 | −0.395 | 1.992 |
| −0.918 | −0.382 | 1.992 |
| −0.848 | −0.328 | 1.992 |
| −0.775 | −0.279 | 1.992 |
| −0.625 | −0.192 | 1.992 |
| −0.468 | −0.125 | 1.992 |
| −0.306 | −0.081 | 1.992 |
| −0.140 | −0.063 | 1.992 |
| 0.024 | −0.072 | 1.992 |
| 0.182 | −0.107 | 1.992 |
| 0.332 | −0.167 | 1.992 |
| 0.470 | −0.248 | 1.992 |
| 0.595 | −0.345 | 1.992 |
| 0.652 | −0.398 | 1.992 |
| 0.708 | −0.454 | 1.992 |
| 0.810 | −0.572 | 1.992 |
| 0.858 | −0.633 | 1.992 |
| 0.904 | −0.695 | 1.992 |
| 0.991 | −0.823 | 1.992 |
| 1.073 | −0.954 | 1.992 |
| 1.150 | −1.088 | 1.992 |
| 1.124 | −1.126 | 2.390 |
| 1.128 | −1.133 | 2.390 |
| 1.132 | −1.140 | 2.390 |
| 1.137 | −1.146 | 2.390 |
| 1.143 | −1.151 | 2.390 |
| 1.150 | −1.155 | 2.390 |
| 1.157 | −1.157 | 2.390 |
| 1.165 | −1.156 | 2.390 |
| 1.172 | −1.154 | 2.390 |
| 1.179 | −1.150 | 2.390 |
| 1.184 | −1.145 | 2.390 |
| 1.188 | −1.138 | 2.390 |
| 1.190 | −1.130 | 2.390 |
| 1.190 | −1.123 | 2.390 |
| 1.189 | −1.115 | 2.390 |
| 1.187 | −1.107 | 2.390 |
| 1.184 | −1.098 | 2.390 |
| 1.149 | −1.007 | 2.390 |
| 1.114 | −0.916 | 2.390 |
| 1.078 | −0.824 | 2.390 |
| 1.040 | −0.732 | 2.390 |
| 0.961 | −0.547 | 2.390 |
| 0.920 | −0.454 | 2.390 |
| 0.877 | −0.361 | 2.390 |
| 0.832 | −0.268 | 2.390 |
| 0.786 | −0.175 | 2.390 |
| 0.736 | −0.083 | 2.390 |
| 0.682 | 0.008 | 2.390 |
| 0.624 | 0.097 | 2.390 |
| 0.560 | 0.182 | 2.390 |
| 0.489 | 0.262 | 2.390 |
| 0.410 | 0.336 | 2.390 |
| 0.323 | 0.401 | 2.390 |

TABLE 1-continued

| X | Y | Z |
|---|---|---|
| 0.229 | 0.455 | 2.390 |
| 0.128 | 0.495 | 2.390 |
| 0.022 | 0.520 | 2.390 |
| −0.088 | 0.529 | 2.390 |
| −0.197 | 0.522 | 2.390 |
| −0.305 | 0.499 | 2.390 |
| −0.410 | 0.460 | 2.390 |
| −0.602 | 0.346 | 2.390 |
| −0.768 | 0.193 | 2.390 |
| −0.841 | 0.106 | 2.390 |
| −0.910 | 0.015 | 2.390 |
| −0.974 | −0.079 | 2.390 |
| −1.034 | −0.177 | 2.390 |
| −1.055 | −0.215 | 2.390 |
| −1.064 | −0.235 | 2.390 |
| −1.071 | −0.257 | 2.390 |
| −1.072 | −0.304 | 2.390 |
| −1.064 | −0.326 | 2.390 |
| −1.050 | −0.345 | 2.390 |
| −1.030 | −0.357 | 2.390 |
| −1.007 | −0.363 | 2.390 |
| −0.984 | −0.363 | 2.390 |
| −0.962 | −0.357 | 2.390 |
| −0.922 | −0.336 | 2.390 |
| −0.905 | −0.324 | 2.390 |
| −0.888 | −0.312 | 2.390 |
| −0.815 | −0.262 | 2.390 |
| −0.740 | −0.217 | 2.390 |
| −0.586 | −0.142 | 2.390 |
| −0.426 | −0.088 | 2.390 |
| −0.263 | −0.058 | 2.390 |
| −0.099 | −0.053 | 2.390 |
| 0.063 | −0.075 | 2.390 |
| 0.216 | −0.121 | 2.390 |
| 0.359 | −0.191 | 2.390 |
| 0.490 | −0.279 | 2.390 |
| 0.607 | −0.382 | 2.390 |
| 0.661 | −0.438 | 2.390 |
| 0.712 | −0.495 | 2.390 |
| 0.807 | −0.615 | 2.390 |
| 0.852 | −0.676 | 2.390 |
| 0.895 | −0.739 | 2.390 |
| 0.976 | −0.866 | 2.390 |
| 1.052 | −0.995 | 2.390 |
| 1.124 | −1.126 | 2.390 |
| 1.097 | −1.160 | 2.789 |
| 1.101 | −1.167 | 2.789 |
| 1.105 | −1.173 | 2.789 |
| 1.109 | −1.179 | 2.789 |
| 1.115 | −1.184 | 2.789 |
| 1.122 | −1.188 | 2.789 |
| 1.129 | −1.190 | 2.789 |
| 1.136 | −1.190 | 2.789 |
| 1.143 | −1.188 | 2.789 |
| 1.149 | −1.184 | 2.789 |
| 1.155 | −1.179 | 2.789 |
| 1.158 | −1.172 | 2.789 |
| 1.160 | −1.165 | 2.789 |
| 1.161 | −1.157 | 2.789 |
| 1.160 | −1.149 | 2.789 |
| 1.158 | −1.142 | 2.789 |
| 1.155 | −1.134 | 2.789 |
| 1.123 | −1.044 | 2.789 |
| 1.089 | −0.954 | 2.789 |
| 1.055 | −0.864 | 2.789 |
| 1.020 | −0.774 | 2.789 |
| 0.945 | −0.592 | 2.789 |
| 0.906 | −0.500 | 2.789 |
| 0.866 | −0.409 | 2.789 |
| 0.825 | −0.317 | 2.789 |
| 0.781 | −0.225 | 2.789 |
| 0.735 | −0.133 | 2.789 |
| 0.685 | −0.043 | 2.789 |
| 0.632 | 0.046 | 2.789 |
| 0.573 | 0.133 | 2.789 |
| 0.508 | 0.216 | 2.789 |
| 0.436 | 0.293 | 2.789 |

TABLE 1-continued

| X | Y | Z |
|---|---|---|
| 0.356 | 0.364 | 2.789 |
| 0.268 | 0.424 | 2.789 |
| 0.173 | 0.473 | 2.789 |
| 0.072 | 0.509 | 2.789 |
| −0.033 | 0.529 | 2.789 |
| −0.141 | 0.532 | 2.789 |
| −0.249 | 0.520 | 2.789 |
| −0.354 | 0.492 | 2.789 |
| −0.551 | 0.394 | 2.789 |
| −0.724 | 0.253 | 2.789 |
| −0.801 | 0.172 | 2.789 |
| −0.872 | 0.085 | 2.789 |
| −0.939 | −0.007 | 2.789 |
| −1.001 | −0.101 | 2.789 |
| −1.023 | −0.139 | 2.789 |
| −1.033 | −0.159 | 2.789 |
| −1.040 | −0.180 | 2.789 |
| −1.044 | −0.227 | 2.789 |
| −1.037 | −0.249 | 2.789 |
| −1.023 | −0.269 | 2.789 |
| −1.003 | −0.282 | 2.789 |
| −0.981 | −0.288 | 2.789 |
| −0.957 | −0.288 | 2.789 |
| −0.935 | −0.283 | 2.789 |
| −0.895 | −0.264 | 2.789 |
| −0.877 | −0.253 | 2.789 |
| −0.859 | −0.241 | 2.789 |
| −0.784 | −0.196 | 2.789 |
| −0.708 | −0.156 | 2.789 |
| −0.551 | −0.093 | 2.789 |
| −0.389 | −0.052 | 2.789 |
| −0.226 | −0.036 | 2.789 |
| −0.063 | −0.045 | 2.789 |
| 0.093 | −0.078 | 2.789 |
| 0.241 | −0.136 | 2.789 |
| 0.377 | −0.213 | 2.789 |
| 0.500 | −0.308 | 2.789 |
| 0.610 | −0.415 | 2.789 |
| 0.661 | −0.472 | 2.789 |
| 0.709 | −0.531 | 2.789 |
| 0.798 | −0.652 | 2.789 |
| 0.840 | −0.714 | 2.789 |
| 0.880 | −0.776 | 2.789 |
| 0.956 | −0.903 | 2.789 |
| 1.029 | −1.030 | 2.789 |
| 1.097 | −1.160 | 2.789 |
| 1.069 | −1.190 | 3.187 |
| 1.072 | −1.197 | 3.187 |
| 1.076 | −1.204 | 3.187 |
| 1.081 | −1.210 | 3.187 |
| 1.086 | −1.215 | 3.187 |
| 1.093 | −1.218 | 3.187 |
| 1.100 | −1.220 | 3.187 |
| 1.107 | −1.220 | 3.187 |
| 1.114 | −1.218 | 3.187 |
| 1.121 | −1.215 | 3.187 |
| 1.126 | −1.209 | 3.187 |
| 1.130 | −1.203 | 3.187 |
| 1.132 | −1.196 | 3.187 |
| 1.132 | −1.188 | 3.187 |
| 1.131 | −1.180 | 3.187 |
| 1.129 | −1.173 | 3.187 |
| 1.127 | −1.165 | 3.187 |
| 1.096 | −1.076 | 3.187 |
| 1.064 | −0.988 | 3.187 |
| 1.031 | −0.899 | 3.187 |
| 0.997 | −0.809 | 3.187 |
| 0.927 | −0.630 | 3.187 |
| 0.890 | −0.539 | 3.187 |
| 0.852 | −0.449 | 3.187 |
| 0.812 | −0.358 | 3.187 |
| 0.771 | −0.268 | 3.187 |
| 0.728 | −0.177 | 3.187 |
| 0.682 | −0.087 | 3.187 |
| 0.632 | 0.001 | 3.187 |
| 0.577 | 0.088 | 3.187 |
| 0.518 | 0.172 | 3.187 |

TABLE 1-continued

| X | Y | Z |
|---|---|---|
| 0.452 | 0.252 | 3.187 |
| 0.379 | 0.326 | 3.187 |
| 0.298 | 0.392 | 3.187 |
| 0.210 | 0.448 | 3.187 |
| 0.115 | 0.493 | 3.187 |
| 0.014 | 0.523 | 3.187 |
| −0.091 | 0.537 | 3.187 |
| −0.197 | 0.536 | 3.187 |
| −0.303 | 0.518 | 3.187 |
| −0.504 | 0.438 | 3.187 |
| −0.682 | 0.311 | 3.187 |
| −0.762 | 0.234 | 3.187 |
| −0.836 | 0.152 | 3.187 |
| −0.905 | 0.064 | 3.187 |
| −0.970 | −0.027 | 3.187 |
| −0.993 | −0.063 | 3.187 |
| −1.003 | −0.083 | 3.187 |
| −1.011 | −0.104 | 3.187 |
| −1.016 | −0.150 | 3.187 |
| −1.010 | −0.173 | 3.187 |
| −0.997 | −0.192 | 3.187 |
| −0.978 | −0.206 | 3.187 |
| −0.956 | −0.213 | 3.187 |
| −0.932 | −0.214 | 3.187 |
| −0.910 | −0.209 | 3.187 |
| −0.869 | −0.192 | 3.187 |
| −0.851 | −0.182 | 3.187 |
| −0.833 | −0.171 | 3.187 |
| −0.757 | −0.130 | 3.187 |
| −0.679 | −0.095 | 3.187 |
| −0.519 | −0.044 | 3.187 |
| −0.356 | −0.017 | 3.187 |
| −0.194 | −0.014 | 3.187 |
| −0.035 | −0.036 | 3.187 |
| 0.116 | −0.081 | 3.187 |
| 0.258 | −0.148 | 3.187 |
| 0.387 | −0.233 | 3.187 |
| 0.502 | −0.333 | 3.187 |
| 0.606 | −0.444 | 3.187 |
| 0.653 | −0.502 | 3.187 |
| 0.698 | −0.562 | 3.187 |
| 0.783 | −0.684 | 3.187 |
| 0.822 | −0.746 | 3.187 |
| 0.861 | −0.808 | 3.187 |
| 0.934 | −0.934 | 3.187 |
| 1.003 | −1.061 | 3.187 |
| 1.069 | −1.190 | 3.187 |
| 1.040 | −1.218 | 3.585 |
| 1.044 | −1.225 | 3.585 |
| 1.047 | −1.232 | 3.585 |
| 1.052 | −1.238 | 3.585 |
| 1.057 | −1.243 | 3.585 |
| 1.064 | −1.247 | 3.585 |
| 1.071 | −1.249 | 3.585 |
| 1.079 | −1.249 | 3.585 |
| 1.086 | −1.247 | 3.585 |
| 1.092 | −1.243 | 3.585 |
| 1.097 | −1.237 | 3.585 |
| 1.101 | −1.231 | 3.585 |
| 1.103 | −1.224 | 3.585 |
| 1.104 | −1.216 | 3.585 |
| 1.103 | −1.208 | 3.585 |
| 1.101 | −1.201 | 3.585 |
| 1.098 | −1.193 | 3.585 |
| 1.069 | −1.105 | 3.585 |
| 1.038 | −1.017 | 3.585 |
| 1.007 | −0.928 | 3.585 |
| 0.974 | −0.840 | 3.585 |
| 0.906 | −0.662 | 3.585 |
| 0.871 | −0.573 | 3.585 |
| 0.834 | −0.484 | 3.585 |
| 0.796 | −0.394 | 3.585 |
| 0.757 | −0.305 | 3.585 |
| 0.716 | −0.216 | 3.585 |
| 0.672 | −0.127 | 3.585 |
| 0.625 | −0.039 | 3.585 |
| 0.575 | 0.047 | 3.585 |

TABLE 1-continued

| X | Y | Z |
|---|---|---|
| 0.520 | 0.131 | 3.585 |
| 0.459 | 0.212 | 3.585 |
| 0.392 | 0.289 | 3.585 |
| 0.319 | 0.359 | 3.585 |
| 0.237 | 0.422 | 3.585 |
| 0.148 | 0.473 | 3.585 |
| 0.053 | 0.512 | 3.585 |
| −0.048 | 0.537 | 3.585 |
| −0.152 | 0.545 | 3.585 |
| −0.257 | 0.538 | 3.585 |
| −0.459 | 0.476 | 3.585 |
| −0.643 | 0.364 | 3.585 |
| −0.725 | 0.294 | 3.585 |
| −0.802 | 0.217 | 3.585 |
| −0.873 | 0.134 | 3.585 |
| −0.940 | 0.046 | 3.585 |
| −0.963 | 0.012 | 3.585 |
| −0.974 | −0.007 | 3.585 |
| −0.983 | −0.028 | 3.585 |
| −0.989 | −0.073 | 3.585 |
| −0.984 | −0.095 | 3.585 |
| −0.972 | −0.115 | 3.585 |
| −0.954 | −0.129 | 3.585 |
| −0.932 | −0.136 | 3.585 |
| −0.909 | −0.138 | 3.585 |
| −0.887 | −0.134 | 3.585 |
| −0.846 | −0.119 | 3.585 |
| −0.827 | −0.110 | 3.585 |
| −0.809 | −0.100 | 3.585 |
| −0.732 | −0.064 | 3.585 |
| −0.653 | −0.034 | 3.585 |
| −0.492 | 0.006 | 3.585 |
| −0.330 | 0.020 | 3.585 |
| −0.169 | 0.010 | 3.585 |
| −0.014 | −0.025 | 3.585 |
| 0.132 | −0.081 | 3.585 |
| 0.267 | −0.157 | 3.585 |
| 0.389 | −0.250 | 3.585 |
| 0.498 | −0.354 | 3.585 |
| 0.595 | −0.468 | 3.585 |
| 0.640 | −0.527 | 3.585 |
| 0.683 | −0.587 | 3.585 |
| 0.763 | −0.710 | 3.585 |
| 0.801 | −0.773 | 3.585 |
| 0.838 | −0.835 | 3.585 |
| 0.909 | −0.962 | 3.585 |
| 0.976 | −1.089 | 3.585 |
| 1.040 | −1.218 | 3.585 |
| 1.011 | −1.244 | 3.984 |
| 1.015 | −1.251 | 3.984 |
| 1.019 | −1.258 | 3.984 |
| 1.023 | −1.264 | 3.984 |
| 1.029 | −1.269 | 3.984 |
| 1.035 | −1.273 | 3.984 |
| 1.042 | −1.275 | 3.984 |
| 1.050 | −1.275 | 3.984 |
| 1.057 | −1.273 | 3.984 |
| 1.064 | −1.269 | 3.984 |
| 1.069 | −1.264 | 3.984 |
| 1.073 | −1.257 | 3.984 |
| 1.075 | −1.250 | 3.984 |
| 1.075 | −1.242 | 3.984 |
| 1.074 | −1.234 | 3.984 |
| 1.073 | −1.227 | 3.984 |
| 1.070 | −1.219 | 3.984 |
| 1.041 | −1.131 | 3.984 |
| 1.012 | −1.044 | 3.984 |
| 0.981 | −0.956 | 3.984 |
| 0.950 | −0.868 | 3.984 |
| 0.884 | −0.692 | 3.984 |
| 0.849 | −0.604 | 3.984 |
| 0.814 | −0.515 | 3.984 |
| 0.777 | −0.427 | 3.984 |
| 0.739 | −0.339 | 3.984 |
| 0.700 | −0.251 | 3.984 |
| 0.658 | −0.163 | 3.984 |
| 0.614 | −0.076 | 3.984 |

TABLE 1-continued

| X | Y | Z |
|---|---|---|
| 0.567 | 0.009 | 3.984 |
| 0.516 | 0.093 | 3.984 |
| 0.460 | 0.175 | 3.984 |
| 0.399 | 0.253 | 3.984 |
| 0.331 | 0.327 | 3.984 |
| 0.256 | 0.394 | 3.984 |
| 0.173 | 0.452 | 3.984 |
| 0.083 | 0.498 | 3.984 |
| −0.013 | 0.532 | 3.984 |
| −0.114 | 0.550 | 3.984 |
| −0.217 | 0.551 | 3.984 |
| −0.419 | 0.509 | 3.984 |
| −0.606 | 0.414 | 3.984 |
| −0.691 | 0.351 | 3.984 |
| −0.770 | 0.280 | 3.984 |
| −0.843 | 0.202 | 3.984 |
| −0.911 | 0.119 | 3.984 |
| −0.935 | 0.086 | 3.984 |
| −0.946 | 0.068 | 3.984 |
| −0.955 | 0.048 | 3.984 |
| −0.963 | 0.005 | 3.984 |
| −0.959 | −0.017 | 3.984 |
| −0.948 | −0.036 | 3.984 |
| −0.931 | −0.051 | 3.984 |
| −0.910 | −0.058 | 3.984 |
| −0.888 | −0.060 | 3.984 |
| −0.866 | −0.058 | 3.984 |
| −0.826 | −0.045 | 3.984 |
| −0.807 | −0.037 | 3.984 |
| −0.789 | −0.028 | 3.984 |
| −0.711 | 0.003 | 3.984 |
| −0.632 | 0.028 | 3.984 |
| −0.471 | 0.057 | 3.984 |
| −0.309 | 0.059 | 3.984 |
| −0.152 | 0.036 | 3.984 |
| −0.001 | −0.010 | 3.984 |
| 0.140 | −0.077 | 3.984 |
| 0.268 | −0.162 | 3.984 |
| 0.384 | −0.261 | 3.984 |
| 0.487 | −0.370 | 3.984 |
| 0.580 | −0.487 | 3.984 |
| 0.623 | −0.547 | 3.984 |
| 0.664 | −0.608 | 3.984 |
| 0.741 | −0.733 | 3.984 |
| 0.778 | −0.796 | 3.984 |
| 0.814 | −0.859 | 3.984 |
| 0.882 | −0.986 | 3.984 |
| 0.948 | −1.115 | 3.984 |
| 1.011 | −1.244 | 3.984 |
| 0.983 | −1.268 | 4.382 |
| 0.986 | −1.275 | 4.382 |
| 0.990 | −1.282 | 4.382 |
| 0.994 | −1.289 | 4.382 |
| 1.000 | −1.294 | 4.382 |
| 1.007 | −1.298 | 4.382 |
| 1.014 | −1.300 | 4.382 |
| 1.021 | −1.300 | 4.382 |
| 1.029 | −1.298 | 4.382 |
| 1.035 | −1.294 | 4.382 |
| 1.041 | −1.289 | 4.382 |
| 1.044 | −1.282 | 4.382 |
| 1.047 | −1.275 | 4.382 |
| 1.047 | −1.267 | 4.382 |
| 1.046 | −1.259 | 4.382 |
| 1.044 | −1.251 | 4.382 |
| 1.042 | −1.244 | 4.382 |
| 1.014 | −1.157 | 4.382 |
| 0.985 | −1.070 | 4.382 |
| 0.955 | −0.983 | 4.382 |
| 0.924 | −0.895 | 4.382 |
| 0.860 | −0.720 | 4.382 |
| 0.827 | −0.633 | 4.382 |
| 0.792 | −0.546 | 4.382 |
| 0.756 | −0.458 | 4.382 |
| 0.720 | −0.371 | 4.382 |
| 0.681 | −0.284 | 4.382 |
| 0.641 | −0.197 | 4.382 |

TABLE 1-continued

| X | Y | Z |
|---|---|---|
| 0.599 | −0.111 | 4.382 |
| 0.555 | −0.026 | 4.382 |
| 0.507 | 0.058 | 4.382 |
| 0.455 | 0.140 | 4.382 |
| 0.398 | 0.220 | 4.382 |
| 0.335 | 0.295 | 4.382 |
| 0.266 | 0.366 | 4.382 |
| 0.189 | 0.428 | 4.382 |
| 0.104 | 0.481 | 4.382 |
| 0.013 | 0.522 | 4.382 |
| −0.084 | 0.548 | 4.382 |
| −0.184 | 0.559 | 4.382 |
| −0.384 | 0.536 | 4.382 |
| −0.572 | 0.459 | 4.382 |
| −0.659 | 0.404 | 4.382 |
| −0.739 | 0.340 | 4.382 |
| −0.814 | 0.268 | 4.382 |
| −0.883 | 0.191 | 4.382 |
| −0.908 | 0.160 | 4.382 |
| −0.919 | 0.143 | 4.382 |
| −0.928 | 0.125 | 4.382 |
| −0.938 | 0.084 | 4.382 |
| −0.935 | 0.063 | 4.382 |
| −0.926 | 0.044 | 4.382 |
| −0.910 | 0.030 | 4.382 |
| −0.890 | 0.022 | 4.382 |
| −0.869 | 0.019 | 4.382 |
| −0.848 | 0.021 | 4.382 |
| −0.809 | 0.031 | 4.382 |
| −0.791 | 0.038 | 4.382 |
| −0.773 | 0.045 | 4.382 |
| −0.695 | 0.071 | 4.382 |
| −0.616 | 0.091 | 4.382 |
| −0.456 | 0.110 | 4.382 |
| −0.296 | 0.101 | 4.382 |
| −0.142 | 0.067 | 4.382 |
| 0.005 | 0.010 | 4.382 |
| 0.140 | −0.067 | 4.382 |
| 0.263 | −0.160 | 4.382 |
| 0.374 | −0.265 | 4.382 |
| 0.472 | −0.380 | 4.382 |
| 0.562 | −0.500 | 4.382 |
| 0.603 | −0.562 | 4.382 |
| 0.643 | −0.625 | 4.382 |
| 0.718 | −0.752 | 4.382 |
| 0.754 | −0.816 | 4.382 |
| 0.789 | −0.880 | 4.382 |
| 0.856 | −1.009 | 4.382 |
| 0.921 | −1.138 | 4.382 |
| 0.983 | −1.268 | 4.382 |
| 0.954 | −1.291 | 4.780 |
| 0.958 | −1.298 | 4.780 |
| 0.962 | −1.305 | 4.780 |
| 0.966 | −1.312 | 4.780 |
| 0.972 | −1.317 | 4.780 |
| 0.978 | −1.321 | 4.780 |
| 0.985 | −1.323 | 4.780 |
| 0.993 | −1.323 | 4.780 |
| 1.000 | −1.321 | 4.780 |
| 1.007 | −1.317 | 4.780 |
| 1.012 | −1.312 | 4.780 |
| 1.016 | −1.305 | 4.780 |
| 1.018 | −1.298 | 4.780 |
| 1.019 | −1.290 | 4.780 |
| 1.018 | −1.283 | 4.780 |
| 1.016 | −1.275 | 4.780 |
| 1.014 | −1.267 | 4.780 |
| 0.986 | −1.181 | 4.780 |
| 0.958 | −1.095 | 4.780 |
| 0.929 | −1.008 | 4.780 |
| 0.899 | −0.921 | 4.780 |
| 0.836 | −0.748 | 4.780 |
| 0.803 | −0.661 | 4.780 |
| 0.769 | −0.574 | 4.780 |
| 0.734 | −0.488 | 4.780 |
| 0.698 | −0.401 | 4.780 |
| 0.661 | −0.314 | 4.780 |

TABLE 1-continued

| X | Y | Z |
|---|---|---|
| 0.622 | −0.228 | 4.780 |
| 0.582 | −0.143 | 4.780 |
| 0.539 | −0.058 | 4.780 |
| 0.494 | 0.026 | 4.780 |
| 0.445 | 0.108 | 4.780 |
| 0.391 | 0.188 | 4.780 |
| 0.333 | 0.265 | 4.780 |
| 0.268 | 0.338 | 4.780 |
| 0.196 | 0.404 | 4.780 |
| 0.117 | 0.462 | 4.780 |
| 0.031 | 0.509 | 4.780 |
| −0.062 | 0.542 | 4.780 |
| −0.158 | 0.562 | 4.780 |
| −0.354 | 0.558 | 4.780 |
| −0.542 | 0.500 | 4.780 |
| −0.629 | 0.453 | 4.780 |
| −0.711 | 0.397 | 4.780 |
| −0.787 | 0.333 | 4.780 |
| −0.857 | 0.261 | 4.780 |
| −0.881 | 0.233 | 4.780 |
| −0.892 | 0.217 | 4.780 |
| −0.902 | 0.201 | 4.780 |
| −0.913 | 0.163 | 4.780 |
| −0.912 | 0.144 | 4.780 |
| −0.904 | 0.126 | 4.780 |
| −0.890 | 0.112 | 4.780 |
| −0.872 | 0.104 | 4.780 |
| −0.852 | 0.100 | 4.780 |
| −0.833 | 0.100 | 4.780 |
| −0.795 | 0.108 | 4.780 |
| −0.777 | 0.113 | 4.780 |
| −0.760 | 0.119 | 4.780 |
| −0.683 | 0.139 | 4.780 |
| −0.605 | 0.154 | 4.780 |
| −0.447 | 0.163 | 4.780 |
| −0.289 | 0.145 | 4.780 |
| −0.138 | 0.101 | 4.780 |
| 0.004 | 0.034 | 4.780 |
| 0.134 | −0.052 | 4.780 |
| 0.252 | −0.153 | 4.780 |
| 0.359 | −0.265 | 4.780 |
| 0.454 | −0.384 | 4.780 |
| 0.540 | −0.509 | 4.780 |
| 0.581 | −0.573 | 4.780 |
| 0.620 | −0.637 | 4.780 |
| 0.693 | −0.767 | 4.780 |
| 0.729 | −0.833 | 4.780 |
| 0.763 | −0.898 | 4.780 |
| 0.830 | −1.029 | 4.780 |
| 0.893 | −1.160 | 4.780 |
| 0.954 | −1.291 | 4.780 |
| 0.926 | −1.312 | 5.179 |
| 0.930 | −1.320 | 5.179 |
| 0.933 | −1.327 | 5.179 |
| 0.938 | −1.333 | 5.179 |
| 0.943 | −1.338 | 5.179 |
| 0.950 | −1.342 | 5.179 |
| 0.957 | −1.344 | 5.179 |
| 0.965 | −1.344 | 5.179 |
| 0.972 | −1.343 | 5.179 |
| 0.979 | −1.339 | 5.179 |
| 0.984 | −1.334 | 5.179 |
| 0.988 | −1.327 | 5.179 |
| 0.990 | −1.320 | 5.179 |
| 0.991 | −1.312 | 5.179 |
| 0.990 | −1.305 | 5.179 |
| 0.988 | −1.297 | 5.179 |
| 0.986 | −1.289 | 5.179 |
| 0.958 | −1.204 | 5.179 |
| 0.931 | −1.118 | 5.179 |
| 0.902 | −1.032 | 5.179 |
| 0.872 | −0.946 | 5.179 |
| 0.810 | −0.774 | 5.179 |
| 0.778 | −0.688 | 5.179 |
| 0.745 | −0.601 | 5.179 |
| 0.710 | −0.515 | 5.179 |
| 0.675 | −0.429 | 5.179 |

TABLE 1-continued

| X | Y | Z |
|---|---|---|
| 0.639 | −0.343 | 5.179 |
| 0.601 | −0.257 | 5.179 |
| 0.562 | −0.172 | 5.179 |
| 0.521 | −0.087 | 5.179 |
| 0.477 | −0.003 | 5.179 |
| 0.430 | 0.079 | 5.179 |
| 0.380 | 0.160 | 5.179 |
| 0.325 | 0.237 | 5.179 |
| 0.264 | 0.311 | 5.179 |
| 0.197 | 0.380 | 5.179 |
| 0.122 | 0.441 | 5.179 |
| 0.041 | 0.493 | 5.179 |
| −0.046 | 0.534 | 5.179 |
| −0.138 | 0.561 | 5.179 |
| −0.328 | 0.576 | 5.179 |
| −0.514 | 0.537 | 5.179 |
| −0.602 | 0.499 | 5.179 |
| −0.685 | 0.452 | 5.179 |
| −0.761 | 0.394 | 5.179 |
| −0.832 | 0.330 | 5.179 |
| −0.856 | 0.304 | 5.179 |
| −0.867 | 0.290 | 5.179 |
| −0.877 | 0.275 | 5.179 |
| −0.889 | 0.241 | 5.179 |
| −0.889 | 0.223 | 5.179 |
| −0.883 | 0.206 | 5.179 |
| −0.871 | 0.193 | 5.179 |
| −0.855 | 0.184 | 5.179 |
| −0.837 | 0.180 | 5.179 |
| −0.819 | 0.179 | 5.179 |
| −0.783 | 0.184 | 5.179 |
| −0.766 | 0.188 | 5.179 |
| −0.749 | 0.192 | 5.179 |
| −0.674 | 0.207 | 5.179 |
| −0.597 | 0.216 | 5.179 |
| −0.441 | 0.217 | 5.179 |
| −0.287 | 0.190 | 5.179 |
| −0.139 | 0.136 | 5.179 |
| −0.002 | 0.060 | 5.179 |
| 0.124 | −0.034 | 5.179 |
| 0.237 | −0.142 | 5.179 |
| 0.340 | −0.260 | 5.179 |
| 0.433 | −0.385 | 5.179 |
| 0.517 | −0.515 | 5.179 |
| 0.557 | −0.580 | 5.179 |
| 0.595 | −0.647 | 5.179 |
| 0.668 | −0.780 | 5.179 |
| 0.703 | −0.847 | 5.179 |
| 0.737 | −0.914 | 5.179 |
| 0.803 | −1.048 | 5.179 |
| 0.866 | −1.181 | 5.179 |
| 0.926 | −1.312 | 5.179 |
| 0.899 | −1.332 | 5.577 |
| 0.902 | −1.339 | 5.577 |
| 0.906 | −1.346 | 5.577 |
| 0.910 | −1.353 | 5.577 |
| 0.916 | −1.358 | 5.577 |
| 0.922 | −1.362 | 5.577 |
| 0.929 | −1.364 | 5.577 |
| 0.937 | −1.364 | 5.577 |
| 0.944 | −1.362 | 5.577 |
| 0.951 | −1.359 | 5.577 |
| 0.956 | −1.353 | 5.577 |
| 0.960 | −1.347 | 5.577 |
| 0.962 | −1.340 | 5.577 |
| 0.962 | −1.332 | 5.577 |
| 0.962 | −1.325 | 5.577 |
| 0.960 | −1.317 | 5.577 |
| 0.958 | −1.310 | 5.577 |
| 0.931 | −1.225 | 5.577 |
| 0.903 | −1.140 | 5.577 |
| 0.875 | −1.055 | 5.577 |
| 0.845 | −0.969 | 5.577 |
| 0.784 | −0.798 | 5.577 |
| 0.752 | −0.712 | 5.577 |
| 0.720 | −0.626 | 5.577 |
| 0.686 | −0.540 | 5.577 |

TABLE 1-continued

| X | Y | Z |
|---|---|---|
| 0.651 | −0.454 | 5.577 |
| 0.615 | −0.369 | 5.577 |
| 0.578 | −0.283 | 5.577 |
| 0.540 | −0.198 | 5.577 |
| 0.500 | −0.113 | 5.577 |
| 0.458 | −0.030 | 5.577 |
| 0.413 | 0.053 | 5.577 |
| 0.365 | 0.133 | 5.577 |
| 0.312 | 0.212 | 5.577 |
| 0.255 | 0.287 | 5.577 |
| 0.192 | 0.357 | 5.577 |
| 0.122 | 0.421 | 5.577 |
| 0.046 | 0.477 | 5.577 |
| −0.036 | 0.523 | 5.577 |
| −0.123 | 0.558 | 5.577 |
| −0.306 | 0.590 | 5.577 |
| −0.490 | 0.570 | 5.577 |
| −0.577 | 0.542 | 5.577 |
| −0.660 | 0.503 | 5.577 |
| −0.737 | 0.453 | 5.577 |
| −0.808 | 0.396 | 5.577 |
| −0.832 | 0.373 | 5.577 |
| −0.843 | 0.361 | 5.577 |
| −0.853 | 0.347 | 5.577 |
| −0.866 | 0.317 | 5.577 |
| −0.867 | 0.301 | 5.577 |
| −0.863 | 0.285 | 5.577 |
| −0.853 | 0.272 | 5.577 |
| −0.839 | 0.263 | 5.577 |
| −0.823 | 0.258 | 5.577 |
| −0.807 | 0.256 | 5.577 |
| −0.773 | 0.258 | 5.577 |
| −0.757 | 0.260 | 5.577 |
| −0.740 | 0.263 | 5.577 |
| −0.666 | 0.272 | 5.577 |
| −0.591 | 0.277 | 5.577 |
| −0.439 | 0.269 | 5.577 |
| −0.288 | 0.234 | 5.577 |
| −0.145 | 0.172 | 5.577 |
| −0.012 | 0.088 | 5.577 |
| 0.110 | −0.014 | 5.577 |
| 0.219 | −0.129 | 5.577 |
| 0.319 | −0.253 | 5.577 |
| 0.410 | −0.383 | 5.577 |
| 0.493 | −0.517 | 5.577 |
| 0.532 | −0.585 | 5.577 |
| 0.570 | −0.653 | 5.577 |
| 0.642 | −0.791 | 5.577 |
| 0.677 | −0.859 | 5.577 |
| 0.711 | −0.928 | 5.577 |
| 0.776 | −1.064 | 5.577 |
| 0.839 | −1.199 | 5.577 |
| 0.899 | −1.332 | 5.577 |
| 0.871 | −1.349 | 5.975 |
| 0.874 | −1.357 | 5.975 |
| 0.878 | −1.364 | 5.975 |
| 0.882 | −1.370 | 5.975 |
| 0.888 | −1.375 | 5.975 |
| 0.894 | −1.379 | 5.975 |
| 0.902 | −1.381 | 5.975 |
| 0.909 | −1.382 | 5.975 |
| 0.916 | −1.380 | 5.975 |
| 0.923 | −1.376 | 5.975 |
| 0.928 | −1.371 | 5.975 |
| 0.932 | −1.365 | 5.975 |
| 0.934 | −1.358 | 5.975 |
| 0.934 | −1.350 | 5.975 |
| 0.934 | −1.343 | 5.975 |
| 0.932 | −1.335 | 5.975 |
| 0.930 | −1.328 | 5.975 |
| 0.903 | −1.244 | 5.975 |
| 0.876 | −1.160 | 5.975 |
| 0.847 | −1.075 | 5.975 |
| 0.818 | −0.990 | 5.975 |
| 0.758 | −0.820 | 5.975 |
| 0.726 | −0.734 | 5.975 |
| 0.694 | −0.649 | 5.975 |

TABLE 1-continued

| X | Y | Z |
|---|---|---|
| 0.660 | −0.563 | 5.975 |
| 0.626 | −0.477 | 5.975 |
| 0.591 | −0.391 | 5.975 |
| 0.555 | −0.306 | 5.975 |
| 0.517 | −0.221 | 5.975 |
| 0.478 | −0.137 | 5.975 |
| 0.437 | −0.053 | 5.975 |
| 0.393 | 0.029 | 5.975 |
| 0.347 | 0.110 | 5.975 |
| 0.297 | 0.189 | 5.975 |
| 0.242 | 0.264 | 5.975 |
| 0.183 | 0.335 | 5.975 |
| 0.118 | 0.401 | 5.975 |
| 0.047 | 0.461 | 5.975 |
| −0.030 | 0.512 | 5.975 |
| −0.112 | 0.553 | 5.975 |
| −0.287 | 0.601 | 5.975 |
| −0.467 | 0.601 | 5.975 |
| −0.555 | 0.582 | 5.975 |
| −0.638 | 0.551 | 5.975 |
| −0.715 | 0.509 | 5.975 |
| −0.786 | 0.459 | 5.975 |
| −0.810 | 0.438 | 5.975 |
| −0.820 | 0.428 | 5.975 |
| −0.830 | 0.416 | 5.975 |
| −0.844 | 0.390 | 5.975 |
| −0.846 | 0.375 | 5.975 |
| −0.844 | 0.361 | 5.975 |
| −0.836 | 0.348 | 5.975 |
| −0.824 | 0.339 | 5.975 |
| −0.810 | 0.334 | 5.975 |
| −0.795 | 0.330 | 5.975 |
| −0.764 | 0.329 | 5.975 |
| −0.749 | 0.330 | 5.975 |
| −0.732 | 0.331 | 5.975 |
| −0.660 | 0.335 | 5.975 |
| −0.587 | 0.335 | 5.975 |
| −0.439 | 0.319 | 5.975 |
| −0.292 | 0.276 | 5.975 |
| −0.152 | 0.207 | 5.975 |
| −0.024 | 0.115 | 5.975 |
| 0.093 | 0.006 | 5.975 |
| 0.199 | −0.115 | 5.975 |
| 0.296 | −0.244 | 5.975 |
| 0.385 | −0.379 | 5.975 |
| 0.468 | −0.517 | 5.975 |
| 0.507 | −0.588 | 5.975 |
| 0.544 | −0.658 | 5.975 |
| 0.616 | −0.799 | 5.975 |
| 0.651 | −0.869 | 5.975 |
| 0.685 | −0.940 | 5.975 |
| 0.750 | −1.079 | 5.975 |
| 0.812 | −1.216 | 5.975 |
| 0.871 | −1.349 | 5.975 |
| 0.844 | −1.365 | 6.374 |
| 0.847 | −1.372 | 6.374 |
| 0.850 | −1.379 | 6.374 |
| 0.855 | −1.385 | 6.374 |
| 0.860 | −1.391 | 6.374 |
| 0.867 | −1.395 | 6.374 |
| 0.874 | −1.397 | 6.374 |
| 0.881 | −1.397 | 6.374 |
| 0.888 | −1.395 | 6.374 |
| 0.895 | −1.391 | 6.374 |
| 0.900 | −1.386 | 6.374 |
| 0.904 | −1.380 | 6.374 |
| 0.906 | −1.373 | 6.374 |
| 0.907 | −1.366 | 6.374 |
| 0.906 | −1.358 | 6.374 |
| 0.904 | −1.351 | 6.374 |
| 0.902 | −1.344 | 6.374 |
| 0.875 | −1.261 | 6.374 |
| 0.848 | −1.177 | 6.374 |
| 0.820 | −1.093 | 6.374 |
| 0.791 | −1.009 | 6.374 |
| 0.731 | −0.839 | 6.374 |
| 0.700 | −0.754 | 6.374 |

TABLE 1-continued

| X | Y | Z |
|---|---|---|
| 0.667 | −0.668 | 6.374 |
| 0.634 | −0.583 | 6.374 |
| 0.601 | −0.497 | 6.374 |
| 0.566 | −0.411 | 6.374 |
| 0.530 | −0.326 | 6.374 |
| 0.493 | −0.241 | 6.374 |
| 0.455 | −0.157 | 6.374 |
| 0.414 | −0.073 | 6.374 |
| 0.372 | 0.009 | 6.374 |
| 0.327 | 0.090 | 6.374 |
| 0.279 | 0.168 | 6.374 |
| 0.227 | 0.244 | 6.374 |
| 0.171 | 0.316 | 6.374 |
| 0.110 | 0.384 | 6.374 |
| 0.043 | 0.446 | 6.374 |
| −0.028 | 0.501 | 6.374 |
| −0.105 | 0.548 | 6.374 |
| −0.272 | 0.611 | 6.374 |
| −0.448 | 0.628 | 6.374 |
| −0.534 | 0.618 | 6.374 |
| −0.617 | 0.596 | 6.374 |
| −0.694 | 0.562 | 6.374 |
| −0.765 | 0.518 | 6.374 |
| −0.789 | 0.500 | 6.374 |
| −0.799 | 0.491 | 6.374 |
| −0.809 | 0.481 | 6.374 |
| −0.823 | 0.458 | 6.374 |
| −0.827 | 0.445 | 6.374 |
| −0.826 | 0.431 | 6.374 |
| −0.820 | 0.419 | 6.374 |
| −0.810 | 0.410 | 6.374 |
| −0.798 | 0.404 | 6.374 |
| −0.784 | 0.400 | 6.374 |
| −0.756 | 0.396 | 6.374 |
| −0.741 | 0.396 | 6.374 |
| −0.725 | 0.396 | 6.374 |
| −0.655 | 0.395 | 6.374 |
| −0.583 | 0.390 | 6.374 |
| −0.439 | 0.365 | 6.374 |
| −0.296 | 0.316 | 6.374 |
| −0.161 | 0.239 | 6.374 |
| −0.037 | 0.141 | 6.374 |
| 0.076 | 0.026 | 6.374 |
| 0.179 | −0.100 | 6.374 |
| 0.273 | −0.235 | 6.374 |
| 0.361 | −0.374 | 6.374 |
| 0.442 | −0.517 | 6.374 |
| 0.481 | −0.589 | 6.374 |
| 0.519 | −0.661 | 6.374 |
| 0.590 | −0.806 | 6.374 |
| 0.625 | −0.878 | 6.374 |
| 0.659 | −0.950 | 6.374 |
| 0.723 | −1.091 | 6.374 |
| 0.785 | −1.230 | 6.374 |
| 0.844 | −1.365 | 6.374 |
| 0.816 | −1.378 | 6.772 |
| 0.820 | −1.385 | 6.772 |
| 0.823 | −1.392 | 6.772 |
| 0.827 | −1.399 | 6.772 |
| 0.833 | −1.404 | 6.772 |
| 0.839 | −1.408 | 6.772 |
| 0.846 | −1.410 | 6.772 |
| 0.854 | −1.410 | 6.772 |
| 0.861 | −1.408 | 6.772 |
| 0.867 | −1.404 | 6.772 |
| 0.872 | −1.399 | 6.772 |
| 0.876 | −1.393 | 6.772 |
| 0.878 | −1.386 | 6.772 |
| 0.879 | −1.379 | 6.772 |
| 0.878 | −1.371 | 6.772 |
| 0.876 | −1.364 | 6.772 |
| 0.874 | −1.357 | 6.772 |
| 0.848 | −1.275 | 6.772 |
| 0.820 | −1.192 | 6.772 |
| 0.793 | −1.108 | 6.772 |
| 0.764 | −1.024 | 6.772 |
| 0.704 | −0.855 | 6.772 |

TABLE 1-continued

| X | Y | Z |
|---|---|---|
| 0.673 | −0.770 | 6.772 |
| 0.641 | −0.685 | 6.772 |
| 0.608 | −0.599 | 6.772 |
| 0.575 | −0.514 | 6.772 |
| 0.540 | −0.428 | 6.772 |
| 0.505 | −0.343 | 6.772 |
| 0.468 | −0.258 | 6.772 |
| 0.431 | −0.174 | 6.772 |
| 0.391 | −0.090 | 6.772 |
| 0.350 | −0.008 | 6.772 |
| 0.306 | 0.073 | 6.772 |
| 0.260 | 0.152 | 6.772 |
| 0.210 | 0.227 | 6.772 |
| 0.157 | 0.300 | 6.772 |
| 0.100 | 0.369 | 6.772 |
| 0.038 | 0.434 | 6.772 |
| −0.029 | 0.492 | 6.772 |
| −0.102 | 0.544 | 6.772 |
| −0.260 | 0.621 | 6.772 |
| −0.430 | 0.654 | 6.772 |
| −0.515 | 0.652 | 6.772 |
| −0.598 | 0.637 | 6.772 |
| −0.675 | 0.611 | 6.772 |
| −0.746 | 0.572 | 6.772 |
| −0.769 | 0.557 | 6.772 |
| −0.780 | 0.549 | 6.772 |
| −0.789 | 0.540 | 6.772 |
| −0.805 | 0.520 | 6.772 |
| −0.809 | 0.509 | 6.772 |
| −0.809 | 0.496 | 6.772 |
| −0.805 | 0.485 | 6.772 |
| −0.796 | 0.475 | 6.772 |
| −0.786 | 0.469 | 6.772 |
| −0.773 | 0.464 | 6.772 |
| −0.747 | 0.458 | 6.772 |
| −0.732 | 0.457 | 6.772 |
| −0.717 | 0.456 | 6.772 |
| −0.649 | 0.450 | 6.772 |
| −0.579 | 0.441 | 6.772 |
| −0.439 | 0.408 | 6.772 |
| −0.301 | 0.351 | 6.772 |
| −0.170 | 0.268 | 6.772 |
| −0.051 | 0.163 | 6.772 |
| 0.059 | 0.043 | 6.772 |
| 0.158 | −0.088 | 6.772 |
| 0.251 | −0.226 | 6.772 |
| 0.337 | −0.370 | 6.772 |
| 0.417 | −0.516 | 6.772 |
| 0.456 | −0.590 | 6.772 |
| 0.493 | −0.664 | 6.772 |
| 0.565 | −0.812 | 6.772 |
| 0.599 | −0.885 | 6.772 |
| 0.633 | −0.958 | 6.772 |
| 0.697 | −1.102 | 6.772 |
| 0.758 | −1.242 | 6.772 |
| 0.816 | −1.378 | 6.772 |
| 0.789 | −1.389 | 7.171 |
| 0.792 | −1.396 | 7.171 |
| 0.796 | −1.403 | 7.171 |
| 0.800 | −1.409 | 7.171 |
| 0.806 | −1.414 | 7.171 |
| 0.812 | −1.418 | 7.171 |
| 0.819 | −1.420 | 7.171 |
| 0.827 | −1.420 | 7.171 |
| 0.834 | −1.418 | 7.171 |
| 0.840 | −1.415 | 7.171 |
| 0.845 | −1.409 | 7.171 |
| 0.849 | −1.403 | 7.171 |
| 0.851 | −1.396 | 7.171 |
| 0.851 | −1.389 | 7.171 |
| 0.850 | −1.382 | 7.171 |
| 0.848 | −1.375 | 7.171 |
| 0.846 | −1.367 | 7.171 |
| 0.820 | −1.286 | 7.171 |
| 0.793 | −1.203 | 7.171 |
| 0.765 | −1.120 | 7.171 |
| 0.737 | −1.036 | 7.171 |

TABLE 1-continued

| X | Y | Z |
|---|---|---|
| 0.677 | −0.868 | 7.171 |
| 0.646 | −0.783 | 7.171 |
| 0.614 | −0.698 | 7.171 |
| 0.582 | −0.612 | 7.171 |
| 0.549 | −0.527 | 7.171 |
| 0.515 | −0.442 | 7.171 |
| 0.480 | −0.356 | 7.171 |
| 0.444 | −0.272 | 7.171 |
| 0.407 | −0.187 | 7.171 |
| 0.369 | −0.104 | 7.171 |
| 0.328 | −0.021 | 7.171 |
| 0.286 | 0.060 | 7.171 |
| 0.241 | 0.138 | 7.171 |
| 0.193 | 0.215 | 7.171 |
| 0.143 | 0.288 | 7.171 |
| 0.089 | 0.359 | 7.171 |
| 0.030 | 0.425 | 7.171 |
| −0.033 | 0.487 | 7.171 |
| −0.101 | 0.542 | 7.171 |
| −0.251 | 0.630 | 7.171 |
| −0.415 | 0.677 | 7.171 |
| −0.498 | 0.683 | 7.171 |
| −0.580 | 0.676 | 7.171 |
| −0.658 | 0.655 | 7.171 |
| −0.729 | 0.622 | 7.171 |
| −0.752 | 0.608 | 7.171 |
| −0.762 | 0.601 | 7.171 |
| −0.772 | 0.593 | 7.171 |
| −0.787 | 0.576 | 7.171 |
| −0.792 | 0.565 | 7.171 |
| −0.794 | 0.553 | 7.171 |
| −0.790 | 0.542 | 7.171 |
| −0.783 | 0.533 | 7.171 |
| −0.773 | 0.526 | 7.171 |
| −0.762 | 0.520 | 7.171 |
| −0.737 | 0.513 | 7.171 |
| −0.723 | 0.511 | 7.171 |
| −0.708 | 0.509 | 7.171 |
| −0.641 | 0.499 | 7.171 |
| −0.574 | 0.486 | 7.171 |
| −0.437 | 0.445 | 7.171 |
| −0.304 | 0.381 | 7.171 |
| −0.178 | 0.291 | 7.171 |
| −0.062 | 0.181 | 7.171 |
| 0.043 | 0.057 | 7.171 |
| 0.140 | −0.078 | 7.171 |
| 0.230 | −0.220 | 7.171 |
| 0.314 | −0.367 | 7.171 |
| 0.393 | −0.516 | 7.171 |
| 0.431 | −0.591 | 7.171 |
| 0.468 | −0.667 | 7.171 |
| 0.539 | −0.817 | 7.171 |
| 0.573 | −0.891 | 7.171 |
| 0.607 | −0.965 | 7.171 |
| 0.671 | −1.111 | 7.171 |
| 0.732 | −1.252 | 7.171 |
| 0.789 | −1.389 | 7.171 |
| 0.762 | −1.397 | 7.569 |
| 0.765 | −1.404 | 7.569 |
| 0.769 | −1.411 | 7.569 |
| 0.773 | −1.417 | 7.569 |
| 0.778 | −1.422 | 7.569 |
| 0.785 | −1.426 | 7.569 |
| 0.792 | −1.428 | 7.569 |
| 0.799 | −1.428 | 7.569 |
| 0.806 | −1.426 | 7.569 |
| 0.813 | −1.422 | 7.569 |
| 0.818 | −1.417 | 7.569 |
| 0.821 | −1.410 | 7.569 |
| 0.823 | −1.404 | 7.569 |
| 0.824 | −1.396 | 7.569 |
| 0.823 | −1.389 | 7.569 |
| 0.821 | −1.382 | 7.569 |
| 0.819 | −1.375 | 7.569 |
| 0.793 | −1.293 | 7.569 |
| 0.766 | −1.211 | 7.569 |
| 0.738 | −1.128 | 7.569 |

TABLE 1-continued

| X | Y | Z |
|---|---|---|
| 0.710 | −1.045 | 7.569 |
| 0.650 | −0.877 | 7.569 |
| 0.620 | −0.792 | 7.569 |
| 0.588 | −0.707 | 7.569 |
| 0.556 | −0.622 | 7.569 |
| 0.523 | −0.537 | 7.569 |
| 0.490 | −0.451 | 7.569 |
| 0.455 | −0.366 | 7.569 |
| 0.420 | −0.282 | 7.569 |
| 0.384 | −0.197 | 7.569 |
| 0.346 | −0.114 | 7.569 |
| 0.307 | −0.031 | 7.569 |
| 0.266 | 0.050 | 7.569 |
| 0.223 | 0.129 | 7.569 |
| 0.178 | 0.206 | 7.569 |
| 0.130 | 0.281 | 7.569 |
| 0.078 | 0.353 | 7.569 |
| 0.023 | 0.421 | 7.569 |
| −0.037 | 0.485 | 7.569 |
| −0.101 | 0.544 | 7.569 |
| −0.244 | 0.640 | 7.569 |
| −0.402 | 0.699 | 7.569 |
| −0.483 | 0.711 | 7.569 |
| −0.564 | 0.710 | 7.569 |
| −0.642 | 0.695 | 7.569 |
| −0.713 | 0.667 | 7.569 |
| −0.737 | 0.654 | 7.569 |
| −0.747 | 0.647 | 7.569 |
| −0.756 | 0.640 | 7.569 |
| −0.772 | 0.623 | 7.569 |
| −0.777 | 0.613 | 7.569 |
| −0.779 | 0.602 | 7.569 |
| −0.776 | 0.591 | 7.569 |
| −0.769 | 0.582 | 7.569 |
| −0.760 | 0.574 | 7.569 |
| −0.750 | 0.569 | 7.569 |
| −0.725 | 0.561 | 7.569 |
| −0.712 | 0.558 | 7.569 |
| −0.697 | 0.555 | 7.569 |
| −0.632 | 0.542 | 7.569 |
| −0.566 | 0.525 | 7.569 |
| −0.433 | 0.477 | 7.569 |
| −0.304 | 0.404 | 7.569 |
| −0.182 | 0.308 | 7.569 |
| −0.071 | 0.194 | 7.569 |
| 0.030 | 0.065 | 7.569 |
| 0.124 | −0.073 | 7.569 |
| 0.211 | −0.217 | 7.569 |
| 0.294 | −0.366 | 7.569 |
| 0.371 | −0.518 | 7.569 |
| 0.408 | −0.594 | 7.569 |
| 0.445 | −0.670 | 7.569 |
| 0.515 | −0.822 | 7.569 |
| 0.548 | −0.897 | 7.569 |
| 0.581 | −0.971 | 7.569 |
| 0.645 | −1.118 | 7.569 |
| 0.705 | −1.260 | 7.569 |
| 0.762 | −1.397 | 7.569 |
| −0.684 | 0.594 | 7.967 |
| −0.698 | 0.597 | 7.967 |
| −0.711 | 0.599 | 7.967 |
| −0.736 | 0.607 | 7.967 |
| −0.746 | 0.613 | 7.967 |
| −0.755 | 0.620 | 7.967 |
| −0.762 | 0.629 | 7.967 |
| −0.765 | 0.640 | 7.967 |
| −0.763 | 0.651 | 7.967 |
| −0.759 | 0.662 | 7.967 |
| −0.743 | 0.679 | 7.967 |
| −0.734 | 0.686 | 7.967 |
| −0.723 | 0.692 | 7.967 |
| −0.700 | 0.705 | 7.967 |
| −0.627 | 0.730 | 7.967 |
| −0.549 | 0.741 | 7.967 |
| −0.470 | 0.736 | 7.967 |
| −0.391 | 0.719 | 7.967 |
| −0.239 | 0.652 | 7.967 |

TABLE 1-continued

| X | Y | Z |
|---|---|---|
| −0.103 | 0.550 | 7.967 |
| −0.041 | 0.490 | 7.967 |
| 0.016 | 0.424 | 7.987 |
| 0.069 | 0.353 | 7.967 |
| 0.119 | 0.280 | 7.967 |
| 0.165 | 0.203 | 7.967 |
| 0.208 | 0.124 | 7.967 |
| 0.249 | 0.044 | 7.967 |
| 0.288 | −0.038 | 7.967 |
| 0.326 | −0.121 | 7.967 |
| 0.362 | −0.204 | 7.967 |
| 0.397 | −0.288 | 7.967 |
| 0.432 | −0.373 | 7.967 |
| 0.465 | −0.458 | 7.967 |
| 0.499 | −0.542 | 7.967 |
| 0.531 | −0.627 | 7.967 |
| 0.563 | −0.712 | 7.967 |
| 0.594 | −0.797 | 7.967 |
| 0.624 | −0.881 | 7.967 |
| 0.683 | −1.049 | 7.967 |
| 0.711 | −1.132 | 7.967 |
| 0.739 | −1.215 | 7.967 |
| 0.765 | −1.297 | 7.967 |
| 0.791 | −1.379 | 7.967 |
| 0.794 | −1.386 | 7.967 |
| 0.795 | −1.393 | 7.967 |
| 0.796 | −1.400 | 7.967 |
| 0.796 | −1.408 | 7.967 |
| 0.794 | −1.415 | 7.967 |
| 0.790 | −1.421 | 7.967 |
| 0.786 | −1.426 | 7.967 |
| 0.779 | −1.430 | 7.967 |
| 0.773 | −1.433 | 7.967 |
| 0.765 | −1.433 | 7.967 |
| 0.758 | −1.431 | 7.967 |
| 0.751 | −1.428 | 7.967 |
| 0.746 | −1.422 | 7.967 |
| 0.742 | −1.416 | 7.967 |
| 0.738 | −1.409 | 7.967 |
| 0.735 | −1.402 | 7.967 |
| 0.678 | −1.265 | 7.967 |
| 0.619 | −1.123 | 7.967 |
| 0.556 | −0.976 | 7.967 |
| 0.524 | −0.902 | 7.967 |
| 0.491 | −0.827 | 7.967 |
| 0.423 | −0.675 | 7.967 |
| 0.387 | −0.598 | 7.967 |
| 0.351 | −0.522 | 7.967 |
| 0.276 | −0.370 | 7.967 |
| 0.197 | −0.219 | 7.967 |
| 0.112 | −0.073 | 7.967 |
| 0.022 | 0.067 | 7.967 |
| −0.076 | 0.199 | 7.967 |
| −0.183 | 0.318 | 7.967 |
| −0.300 | 0.420 | 7.967 |
| −0.425 | 0.501 | 7.967 |
| −0.555 | 0.558 | 7.967 |
| −0.620 | 0.578 | 7.967 |
| −0.684 | 0.594 | 7.967 |

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A turbine blade having an attachment, a platform extending generally radially outward from said attachment, an airfoil extending generally radially outward from said platform, and a shroud extending generally radially outward from said airfoil, said airfoil having an uncoated profile substantially in accordance with Cartesian coordinate values of X, Y, and Z as set forth in Table 1, carried to three decimal places, wherein Z is a distance measured radially from said platform.

2. The turbine blade of claim 1 wherein said airfoil has an envelope within +/−0.100 inches of the profile generated by said Cartesian coordinate values of X, Y, and Z as set forth in Table 1.

3. The turbine blade of claim 1 further comprising a plurality of generally radially extending holes, said holes extending from said attachment, through said platform, said airfoil, and said shroud.

4. The turbine blade of claim 3 wherein said plurality of radially extending holes pass a cooling medium through said blade to cool said airfoil.

5. The turbine blade of claim 4 wherein said cooling medium is air or steam.

6. The turbine blade of claim 5 wherein said plurality of holes comprises six holes.

7. The turbine blade of claim 1 wherein said Cartesian coordinate values of X, Y, and Z as set forth in Table 1 are scaled as a function of the same constant to create a scaled-up or scaled down airfoil.

8. An airfoil for a turbine blade having a shroud, said airfoil having an uncoated profile substantially in accordance with Cartesian coordinate values of X, Y, and Z as set forth in Table 1, carried to three decimal places, wherein Z is a distance measured radially from a platform.

9. The airfoil of claim 8 wherein said airfoil has an envelope within +/−0.100 inches of the profile generated by said Cartesian coordinate values of X, Y, and Z as set forth in Table 1.

10. The airfoil of claim 8 wherein said Cartesian coordinate values of X, Y, and Z as set forth in Table 1 are scaled as a function of the same constant to create a scaled-up or scaled down airfoil.

* * * * *